US012612136B2

(12) United States Patent
Rosen

(10) Patent No.: US 12,612,136 B2
(45) Date of Patent: Apr. 28, 2026

(54) WATER SPORTS DEVICE

(71) Applicant: ROSEN SWISS AG, Stans (CH)

(72) Inventor: Hermann Rosen, Kastanienbaum (CH)

(73) Assignee: ROSENXT HOLDING AG, Stans (CH)

( * ) Notice: Subject to any disclaimer, the term of this patent is extended or adjusted under 35 U.S.C. 154(b) by 849 days.

(21) Appl. No.: 17/755,582

(22) PCT Filed: Nov. 2, 2020

(86) PCT No.: PCT/EP2020/080697
§ 371 (c)(1),
(2) Date: May 2, 2022

(87) PCT Pub. No.: WO2021/084128
PCT Pub. Date: May 6, 2021

(65) Prior Publication Data

US 2022/0363351 A1 Nov. 17, 2022

(30) Foreign Application Priority Data

Nov. 1, 2019 (DE) ..... 102019129577.7

(51) Int. Cl.
*B63B 32/64* (2020.01)
*B63B 1/24* (2020.01)
(Continued)

(52) U.S. Cl.
CPC ..... *B63B 32/64* (2020.02); *B63B 1/242* (2013.01); *B63B 1/246* (2013.01); *B63B 1/30* (2013.01);
(Continued)

(58) Field of Classification Search
CPC ..... B63B 32/64; B63B 1/242; B63B 1/246; B63B 1/30; B63B 32/66; B63B 79/15;
(Continued)

(56) References Cited

U.S. PATENT DOCUMENTS 2,749,870 A 6/1956 Vavra
3,099,239 A 7/1963 Schertel et al.
(Continued)

FOREIGN PATENT DOCUMENTS

BR 202024003361 U2 * 9/2025
CN 204998276 U 1/2016
(Continued)

*Primary Examiner* — Andrew Polay
(74) *Attorney, Agent, or Firm* — Husch Blackwell LLP

(57) ABSTRACT

A holding apparatus is provided by way of which a hydrofoil surface apparatus can be retracted and extended and/or folded, out of a rest and/or starting position into its operating position and/or out of the operating position into the rest and/or starting position. Such actuation can take place manually by way of a person operating the water sports device, with the advantage of simpler transportability of the water sports device. The water sports device can already be placed in water close to the bank or beach, and can be guided or moved from there in the direction of deeper water. As soon as sufficiently deep water is reached, the hydrofoil surface apparatus can be transferred via the holding apparatus into the operating position.

22 Claims, 20 Drawing Sheets

(51) Int. Cl.

| | |
|---|---|
| ***B63B 1/30*** | (2006.01) |
| ***B63B 32/66*** | (2020.01) |
| ***B63B 79/15*** | (2020.01) |
| ***B63B 79/40*** | (2020.01) |

(52) U.S. Cl.
CPC ..... *B63B 32/66* (2020.02); *B63B 79/15* (2020.01); *B63B 79/40* (2020.01)

(58) Field of Classification Search
CPC ..... B63B 79/40; B63B 32/10; B63B 32/60; B63B 1/28; B63B 2001/281
See application file for complete search history.

(56) References Cited

U.S. PATENT DOCUMENTS

| | | | | |
|---|---|---|---|---|
| 3,183,871 | A | 5/1965 | Reder | |
| 4,056,074 | A | 11/1977 | Sachs | |
| 5,117,776 | A * | 6/1992 | Thorpe | B63B 1/26 114/282 |
| 6,789,489 | B1 * | 9/2004 | Phipps | B63H 9/069 114/280 |
| 7,144,285 | B1 * | 12/2006 | Hendricks | B63B 1/286 441/74 |
| 2018/0072383 | A1 | 3/2018 | Montague | |
| 2019/0054980 | A1 | 2/2019 | Dombois | |
| 2020/0079479 | A1 * | 3/2020 | Derrah | B63H 1/16 |
| 2023/0382496 | A1 * | 11/2023 | Giroux | B63B 32/66 |

FOREIGN PATENT DOCUMENTS

| | | | | |
|---|---|---|---|---|
| CN | 107933845 | A | 4/2018 | |
| CN | 108945334 | A * | 12/2018 | B63B 32/00 |
| DE | 102012204827 | A1 | 9/2013 | |
| DE | 102015103553 | A1 | 9/2016 | |
| EP | 0616584 | B1 | 7/1993 | |
| GB | 1581627 | A | 12/1980 | |

* cited by examiner

WATER SPORTS DEVICE

CROSS REFERENCE

This application claims priority to PCT Application No. PCT/EP2020/080697, filed Nov. 2, 2020, which itself claims priority to German Patent Application No. 10 2019 129577.7, filed Nov. 1, 2019, the entirety of both of which is hereby incorporated by reference.

FIELD OF THE INVENTION

The invention relates to a water sports device with a float and at least one hydro-foil surface apparatus which is fastened to the float by means of a holding apparatus, in particular in a movable manner. The holding apparatus has at least one first link. The hydrofoil surface apparatus has at least one hydrofoil surface, and can be transferred via the holding apparatus into an operating position below the float. The float body can be transferred in the operating position and during a forward movement on account of buoyancy which is brought about by way of the hydrofoil surface apparatus into a position which is spaced apart from the water surface.

A water sports device of this type is configured, in particular, as a foilboard, and the float is configured, in particular, as a swimming board. The at least one hydrofoil surface apparatus has, in particular, at least two hydrofoil surfaces. Water sports devices of this type serve as a rule for the movement of persons over bodies of water, which persons, to this end, are situated on that side of the float which faces away from the hydrofoil surface apparatus. During the movement, the hydrofoil surface apparatus is as a rule arranged at least partially below the water surface.

BACKGROUND OF THE INVENTION

DE 10 2015 103 553 A1 has disclosed a water sports device with a hydrofoil surface apparatus which can also be called a foil and can fold away counter to the movement direction in order to avoid damage for the case of underwater contact. US 2018/0072383 A1 has disclosed, furthermore, a hydrofoil surface apparatus which can be transferred by way of an adjustable angle of the connecting strut between the float and the propulsion apparatus out of a first operating position into a further operating position. The two water sports devices according to the prior art require a sufficiently deep body of water for use, since the hydrofoil surface apparatus otherwise makes contact with the bottom and is either damaged or folded away and is therefore no longer fit for movement.

BRIEF SUMMARY OF THE INVENTION

It is an object of the invention to provide a water sports device which can be handled more simply with high reliability.

The object mentioned at the outset is achieved by way of a holding apparatus, by way of which the hydrofoil surface apparatus can be transferred, in particular can be retracted and extended and/or folded, out of a rest and/or starting position into the operating position and/or out of the operating position into the rest and/or starting position. Here, the actuation can take place manually by way of a person operating the water sports device, with the advantage of simpler transportability of the water sports device. The water sports device can already be placed in the, for example, knee-deep water close to the bank or beach, and can be guided or moved from there in the direction of deeper water. As soon as sufficiently deep water is reached, the hydrofoil surface apparatus can be transferred via the holding apparatus into the operating position.

The hydrofoil surface apparatus is therefore configured in such a way that the water sports device can already be used in the rest and/or starting position for movement and, in particular, for acceleration of the water sports device. In this position, in particular, the predominant part or parts of the surfaces of the hydrofoil surface do not lie (at least substantially) perpendicularly in relation to the movement direction in the water in that the rest and/or starting position, with the result that they thus do not brake the propulsion. "At least substantially perpendicularly in the water" means in this case that a surface perpendicular lies in an angular range of ±15° in relation to the movement direction.

The water sports device and, in particular, the holding apparatus preferably have a drive which is provided with an energy store and via which the hydrofoil surface apparatus can be transferred out of a rest and/or starting position into the operating position and/or out of the operating position into the rest and/or starting position. Here, in particular, the hydrofoil surface apparatus can be retracted and/or extended and/or folded in and/or folded out, that is to say the hydrofoil surface apparatus is spaced apart further from the float in the operating position than in the rest and/or starting position. The water sports device can therefore be mounted and started close to the beach or bank, the hydrofoil surface apparatus being situated in a rest and/or starting position. In the case of a sufficiently deep bottom, the hydrofoil surface apparatus is then transferred into the operating position. In the case of returning to the starting location, the hydrofoil surface apparatus is then transferred into the rest and/or starting position close to the float again when the spacing from the bottom becomes smaller. The person situated on the floating unit can move back considerably closer to the bank or the beach without jeopardizing the integrity of the water sports device. The transition into the rest and/or starting position can also take place with taking up of intermediate positions, in which the hydrofoil surface apparatus is not yet as close to the float as in the rest and/or starting position. For triggering the actuation, the drive is preferably provided with a control unit which receives a signal triggered by a utilizing person and forwards a control signal to the drive.

The float is, in particular, a flat, elongate body, the density of which lies considerably below that of water. The float is configured, in particular, in such a way that, during operation, it is at any rate arranged partially above the water surface, preferably independently of a movement speed. During operation, the holding apparatus reaches from the float to the hydrofoil surface apparatus below the float. A buoyancy which is generated by way of the hydrofoil surface apparatus is transmitted by way of the holding apparatus to the float.

The hydrofoil surface apparatus is preferably provided at least in the operating position with at least one hydrofoil surface which is of flat and preferably at least partially wing-shaped or fin-shaped configuration. The width, measured transversely with respect to the movement direction, of the hydrofoil surface apparatus is, in particular, at most twice as great as the width of the float. The hydrofoil surface apparatus serves for stabilization of the movement with the water sports device and for generating buoyancy in the process, the hydrofoil surface apparatus preferably having lateral hydrofoil surface ends in order to boost said effects, which lateral hydrofoil surface ends are angled with respect to the substantially flat water surface. In order to boost said effects, furthermore, the water sports device has, in particular, a plurality of hydrofoil surfaces which are spaced apart from one another in the movement direction and/or are spaced apart from the float to a different extent. The hydrofoil surface apparatus therefore comprises at least one hydrofoil surface and its holder, and possibly a propulsion apparatus.

The at least one link is configured, in particular, as a rigid link. In particular, the link is mounted pivotably relative to the float and/or relative to the hydrofoil surface apparatus. As an alternative or in addition, the at least one, first link is mounted such that it can be moved translationally, in particular can be displaced, relative to the float and/or relative to the hydrofoil surface apparatus. The hydrofoil surface apparatus is coupled to the first link directly or, in particular, indirectly, via further components such as, for example, further links. A linkage component which is configured as a solid body or is of hollow configuration and is attached in an immovable and, in particular, articulated manner, but is otherwise rigid is generally called a link, via which linkage component parts of the water sports device can be moved relative to one another, possibly in combination with one or more further links. The holding apparatus preferably has links which can be pivoted with respect to one another and/or can be displaced into or on one another and are therefore, for example, telescopic.

For the benefit of a greater compactness of the water sports device, the hydrofoil surface apparatus is arranged closer to the float in the rest and/or starting position than in the operating position. In particular, the holding device is folded in and/or retracted in order to transfer the hydrofoil surface apparatus into the rest and/or starting position. In particular, the at least one, first link is pivoted relative to the float by at least 20%, preferably by at least 40%, particularly preferably by at least 80%, for the transfer of the hydrofoil surface apparatus. The hydrofoil surfaces are preferably not spaced apart by more than 50 cm from the float in a lateral view in the rest and/or starting position.

The energy storage is configured, in particular, for storing energy which is necessary for a transfer of the hydrofoil surface apparatus. The store preferably has a re-chargeable battery for storing electric energy, a tank for storing a pressurized fluid, or a mechanical energy store such as a spring. In a first embodiment of the invention, the energy store is configured for feeding a motor which initiates the transfer of the hydrofoil surface apparatus. In one preferred further refinement of the invention, the energy store releases stored energy directly, without a motor being connected in between, as mechanical or kinetic energy for the transfer. The energy store is preferably coupled mechanically on one side to the holding apparatus, and is coupled on the other side to a charging device such as a motor which is configured for charging the energy store, in particular during the use of the water sports device.

As a result of the water sports device according to the invention, the physical effort to be expended by the user for the transfer of the hydrofoil surface apparatus can be reduced considerably. Rather, the drive is merely to be triggered for the transfer, which drive independently implements the transfer or at least reduces the manual effort.

In the rest and/or starting position, the hydrofoil surface of the hydrofoil surface apparatus is preferably oriented at least approximately identically to the operating position, that is to say the orientation of the greatest part of the surfaces (upper and lower side) differs, in particular, by less than 15° in relation to the movement direction, not-withstanding any movable actuating means. A relative movement of the hydrofoil surface apparatus with respect to the float than results in influences which are as constant as possible on the movement of the float. As an alternative, however, the buoyancy and/or the water resistance caused by way of the hydrofoil surfaces is reduced in the rest and/or operating position, for example, by way of a slightly different angular position of the hydrofoil surfaces. As a result, in the rest and/or starting position, influencing of the float movement by way of the hydrofoil surface apparatus is kept as low as possible.

In the case of one development according to the invention of the water sports device, in particular, the hydrofoil surface apparatus is moved at least substantially translationally during the transfer relative to the float. As a result, a simple and therefore reliable mechanism of the holding apparatus is made possible, and the water sports device is particularly space-saving in the rest and/or starting position in the case of the use of conventional hydrofoil surface apparatus geometries.

The drive of the holding apparatus is preferably arranged at least partially, in particular completely, in a recess of the float. In particular, the drive has a surface or cover with a surface which is inserted into the float surface. The surface is, in particular, arranged on the lower side of the float, however. As a result of this arrangement of the drive, the water sports device is streamlined in an optimized manner and even more compact, and can accordingly be operated with less resistance and in a shallow body of water.

The holding apparatus particularly preferably has at least one further link. In particular, the first link and the further link are arranged behind one another in the movement direction at least in the operating position of the hydrofoil surface apparatus. As an alternative or in addition, the first link and/or the second link are arranged in a pivotably movable manner, in particular, on the float and/or on the hydrofoil surface apparatus or a unit or a receptacle which is connected rigidly thereto. In particular, therefore, at least one of the links is arranged in a pivotably movable manner on a receptacle for the at least one hydrofoil surface apparatus or a receptacle of the hydrofoil surface apparatus. Here, the pivot axes are oriented, in particular, transversely with respect to the movement direction and, during operation, parallel to the water surface. As a result, the holding apparatus can be configured as a parallelogram guide which is particularly reliable and by way of which the supporting apparatus remains below the float, in particular, even in the rest and/or starting position.

As an alternative or in addition, the holding apparatus preferably comprises further links which are coupled in each case to one of the two links and, at least in the operating position, adjoin one another between the float and the hydrofoil surface apparatus and transmit force to one another. In particular, the two first or further links can be moved pivotably with respect to one another, as a result of which a toggle lever or folding mechanism can be produced as holding apparatus. For example, in each case two links which configure a toggle lever are arranged behind one another in the movement direction.

As an alternative or in addition, at least one of the two links is displaceable at least at one end relative to the float or relative to the hydrofoil surface apparatus. As a result, a scissor mechanism for the transfer of the hydrofoil surface apparatus can be configured. As an alternative or in addition, at least one of the links is mounted such that it can be moved pivotably relative to the float and/or relative to the hydrofoil surface apparatus about a pivot axis which runs parallel to the movement direction. In particular, the holding apparatus comprises a total of at least four links which are coupled to one another in the manner of a scissor jack (the links which lie in each case opposite one another are at any rate arranged in parallel). Transfer mechanisms and therefore water sports devices which can be handled particularly reliably can be provided by way of the above-described mechanical features of the holding apparatus and/or the links.

As an alternative or in addition, the hydrofoil surface apparatus has telescopic links which are mounted such that they can be displaced longitudinally into or on one another and via which the spacing of the hydrofoil surface apparatus from the float can be varied.

In one advantageous refinement of the invention, the water sports device has at least one depth and/or proximity sensor which is connected to a control unit which is configured to control the drive. The sensor is configured, in particular, for measuring an immersion depth of the water sports device or of a constituent part thereof, and/or for measuring a spacing of the water sports device from the bottom (of the body of water). As an alternative or in addition, the sensor or one of the sensors is configured for measuring a spacing of the water sports device from an obstacle, in particular from any further water sports devices, preferably in the movement direction. The drive is configured, in particular, in such a way that the spacing of the hydrofoil surface apparatus from the float is preferably varied during movement in a manner which is dependent on the sensor data, in particular during the propulsion of the water sports unit; in particular, the hydrofoil surface apparatus is transferred at least partially. As a result, damage to the water sports device as a result of contact with the bottom can be avoided, in particular close to the beach or bank, and unintended operating situations such as, for instance, as a result of the float which is spaced apart too far from the surface of the body of water can be avoided, and the user is assisted in the operation of the water sports device. Therefore, the hydrofoil surface apparatus is preferably extended automatically and/or after release by way of the utilizing person, in an automatic manner after starting close to the bank or beach, if there is sufficient water depth, and is subsequently retracted again correspondingly when returning to the bank/beach.

The sensor is arranged, in particular, on the hydrofoil surface apparatus or the receptacle or the float. The sensor preferably has at least one ultrasonic transducer. As a result, spacings or distances can be determined particularly reliably under water.

As an alternative or in addition to a depth sensor, by way of which the immersion depth of the water sports device is detected, one development according to the invention of a water sports device comprises at least one movement state sensor for determining the spacing of the float from the water surface. The depth and movement state sensor can also be configured by way of a single sensor or a single sensor arrangement.

In particular, the movement state sensor is a sensor unit which is preferably integrated into a link of the holding apparatus or is arranged on said link or holding apparatus. For example, it can be a sensor strip which operates on a capacitive basis and extends along a link of the holding apparatus or is integrated into the latter over the link length. It can likewise be a sensor unit with a plurality of, in particular, capacitive sensors, which sensor unit is arranged spaced apart along the holding apparatus, for example in or on the link thereof. The sensor data can be used to extrapolate the spacing of the float from the water surface by means of the control unit in the case of a known position of the holding apparatus or its link and, in particular in combination with further sensor data, for example in respect of the movement speed and/or the depth of the water, a desired stable movement state can be aimed for, for example by raising or lowering of the float by means of a setting of one or more hydrofoil surfaces or by way of actuation of the holding apparatus or by way of a change in the movement speed. It goes without saying that a movement state sensor of this type which, as a single sensor or a sensor unit comprising a plurality of sensors, is arranged in or on the holding apparatus can also be used in the case of holding apparatuses which are arranged rigidly on the float and in the case of which the holding apparatus holds the hydrofoil surface apparatus in the same position with respect to the float both in the operating position and in the rest and/or starting position.

In particular, the movement state sensor is laminated in, that link of the holding apparatus which has the sensor preferably being produced from a fiber composite material, with the result that firstly a stable construction of the link is achieved and secondly at the same time the integration of the movement state sensor is simplified. Tailored sensor structures can be applied directly to the nonwoven or woven fabric to be used by way of printing processes such as screen printing, dispensing or inkjet printing, the movement state sensor becoming an integral constituent part of the structure of the holding apparatus as a result of the integration of the printed non-woven or woven fabric into the layer structure and subsequent fiber composite production, for example by way of vacuum infusion.

A water sports device, in particular in the form of a hydrofoil board, which is equipped with a movement state sensor preferably has a visual display unit which, in particular, extends at least over half of the length of the upper side of the float and which is configured, in particular, for displaying the spacing of the float from the water surface, for which purpose the display unit has one or preferably a plurality of lights. The spacing from the water surface can preferably correlate, for example, with the number and/or arrangement of the illuminated dots of the display unit, in order to make a sufficiently large display which can be evaluated rapidly possible, even during movement. In particular, RGB diodes can be used for this purpose. For example, in the case of the float lying on the water, no lights or only a few lights which are, for example, red light up and the greater the spacing becomes, the more the number and/or color of the lights over the float link change until a certain, for example maximum, number of illuminated dots are activated in the case of a desired state. For example, a certain, desired or optimum spacing from the water surface can be identified by way of predominantly or exclusively green lights in the form of, for example, RGB LEDs or LED units.

The at least one hydrofoil surface apparatus preferably has at least two wing-like hydrofoil surfaces. They extend, in particular, in each case away from a central vertical axis or a vertical center plane which runs in the movement direction to the left and to the right as viewed in the movement direction. In particular, the two hydrofoil surfaces are of mirror-symmetrical configuration with respect to the vertical plane. At least one or one of the hydrofoil surfaces is particularly preferably of at least approximately delta-shaped configuration as viewed in a plan view. A delta-shaped configuration means a substantially triangular shape, one of the three corners pointing in the movement direction. Here, the lateral flanks are, in particular, of bulbous configuration. As a result of this configuration of the hydrofoil surface apparatus, it has a particularly low flow resistance and makes the greatest possible buoyancy possible.

The water sports device preferably comprises a fastening means which is attached the float, such as an eyelet. The fastening means is assigned, in particular, a sensor which is provided for recording tensile forces. As a result, the water sports device can be coupled to further watercraft and can monitor an introduction of force as a result.

The drive is preferably configured as an electro-mechanical or electro-pneumatic drive. The drive energy is preferably provided in a motorized, electro-mechanical or electro-pneumatic manner. An electro-pneumatic drive has electrically supplied components for setting pneumatic actuators. In particular, compressed air is controlled by way of electric signals. Electro-mechanical drives are distinguished by the production of mechanical operations by way of electric energy. These drive forms ensure a low susceptibility to faults of the water sports device.

The energy store which has, in particular, a spring can preferably be prestressed by means of a motor. In particular, the spring is configured as a torsion spring, the torsion axis of which coincides with the rotational axis of a shaft which is coupled mechanically to the motor. In the case of this construction, the motor serves for prestressing or torsion of the energy store, and generates potential energy therein as a result. The potential energy can be called up for at least partial transfer of the hydrofoil apparatus, without it being necessary for energy generated by the motor to be used directly for this purpose.

The drive has, in particular, a transmission gear mechanism, via which the motor is connected to the energy store. The gear mechanism is configured, in particular, in such a way that the quotient from the time required for the transfer and the time required for the associated prestressing is <1. This means that the drive is configured in such a way that less time is required for the output from the energy store of the energy quantity required for the transfer than for the build-up of the same energy quantity by way of the motor. As a result, the above-described functions can be brought about by way of a motor with a comparatively low rated power output and therefore a relatively small overall size, since the interval between two transfer operations is generally speaking even sufficient for a prestressing time which is therefore long.

The energy store has at least one spring which is connected directly or at least coupled mechanically to at least one link of the holding apparatus, in such a way that the force of the spring can be used at least partially for positioning, in particular for orienting of the link. The energy store can preferably be prestressed in opposite directions by way of the motor and/or the gear mechanism. As a result, both a transfer of the hydrofoil surface apparatus into the operating position and a return from the operating position are at least facilitated by way of the drive. The drive preferably has a brake apparatus which brakes the transfer or the energy output of the energy store and therefore reduces the risk of injury and excessively abrupt influences on the movement of the water sports device.

In one advantageous refinement of the invention, the water sports device has a propulsion apparatus which is provided for its propulsion. The propulsion apparatus is configured at least partially as part of the hydrofoil surface apparatus, or is arranged at least partially between the holding apparatus and the hydrofoil surface apparatus. A particularly stable position of the water sports device is achieved by way of the propulsion apparatus in the immediate vicinity of the hydrofoil surfaces. In particular, a propulsion drop-off in the case of the float lifting up from the water surface is avoided by way of the arrangement of the propulsion apparatus. The propulsion apparatus comprises at least one impeller or propeller, by way of which a great quantity of propulsion can be implemented with merely low flow resistances and a low susceptibility to faults.

In particular, the preferably hub-less and/or shaft-less impeller or propeller is arranged in the flow duct of a propulsion body. The flow duct is connected to the surrounding area via at least two openings, preferably an inlet opening and an outlet opening. One of the openings is preferably configured through a laterally projecting housing wall of the propulsion body. In particular, the propulsion apparatus is of elongate configuration with a substantially round cross section substantially in the movement direction. Here, the inlet opening is preferably arranged in an annular manner between two adjacent propulsion body part pieces of different diameters.

The hydrofoil surface apparatus is preferably configured for setting different angles of attack of at least one part of the one, preferably at least two hydrofoil surfaces, and/or of at least one rudder. As an alternative or in addition, the whole of a hydrofoil surface can be of adjustable configuration. In the case of a plurality of hydrofoil surfaces, only one or several parts of one of the hydrofoil surfaces or only one of the hydrofoil surfaces can be of adjustable configuration. The rudder can be configured as an adjustable section of a hydrofoil surface or as a separate component of the hydrofoil surface apparatus. The direction and/or the magnitude of the buoyancy generated by way of the hydrofoil surfaces can be adapted by way of the adaptation of the angle of attack. Via this, stabilization and/or control of the water sports device can take place. The angle of attack and therefore the buoyancy can be reduced at high speeds of the water sports device, in order that the float is not raised excessively above the water surface. At the same time, the flow resistance can be decreased and the speed can be increased as a result. Conversely, the angle of attack can be increased at low speeds, in order to increase the buoyancy. A movement about an axis which extends in the movement direction can be brought about by way of different angles of attack of two hydrofoil surfaces which lie opposite one another, or an undesired movement out of an equilibrium position can be corrected and the water sports device can therefore be stabilized. Cornering can be assisted or else initiated. By way of different angles of attack of two hydrofoil surfaces which are arranged behind one another, pitching of the watercraft as a result of waves, for example, or as a result of a weight shift of the user on the watercraft toward the front or toward the rear can be countered. In this way, the use of the water sports device can be facilitated.

The angles of attack are particularly preferably said on the basis of control signals of the control unit. To this end, the water sports device preferably has at least one sensor, preferably a plurality of sensors, from a group comprising gyro sensors, speed sensors, position sensors for systems such as GPS, Galileo, Beidou and/or Glonass, distance sensors, for example in the form of echo sounders or sonar sensors, infrared sensors and inclinometers. Here, in particular, acoustic sensors, in particular ultrasonic sensors, can be used. The position of the water sports device relative to a point of comparison or a state of comparison or a state or positional change can be determined by way of at least one of said sensors. The control unit can therefore determine corresponding control signals for changing the angles of attack. Overall, automatic self-stabilization of the watercraft can thus be achieved on its own or in combination with other measures. Moreover, the control unit can determine the spacing of the float from the water service on the basis of sensor data, for example from sensors of the holding apparatus, and can set a defined, in particular desired spacing by way of changing of the angles of attack of the hydrofoil surfaces or parts thereof, and/or can adapt the speed.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

The features explained in the following text of the exemplary embodiments according to the invention can also be a subject matter of the invention individually or in other combinations than those shown or described, but always in combination with the features of claim 1. If appropriate, functionally identical acting parts are provided with identical designations.

Figure 1A:
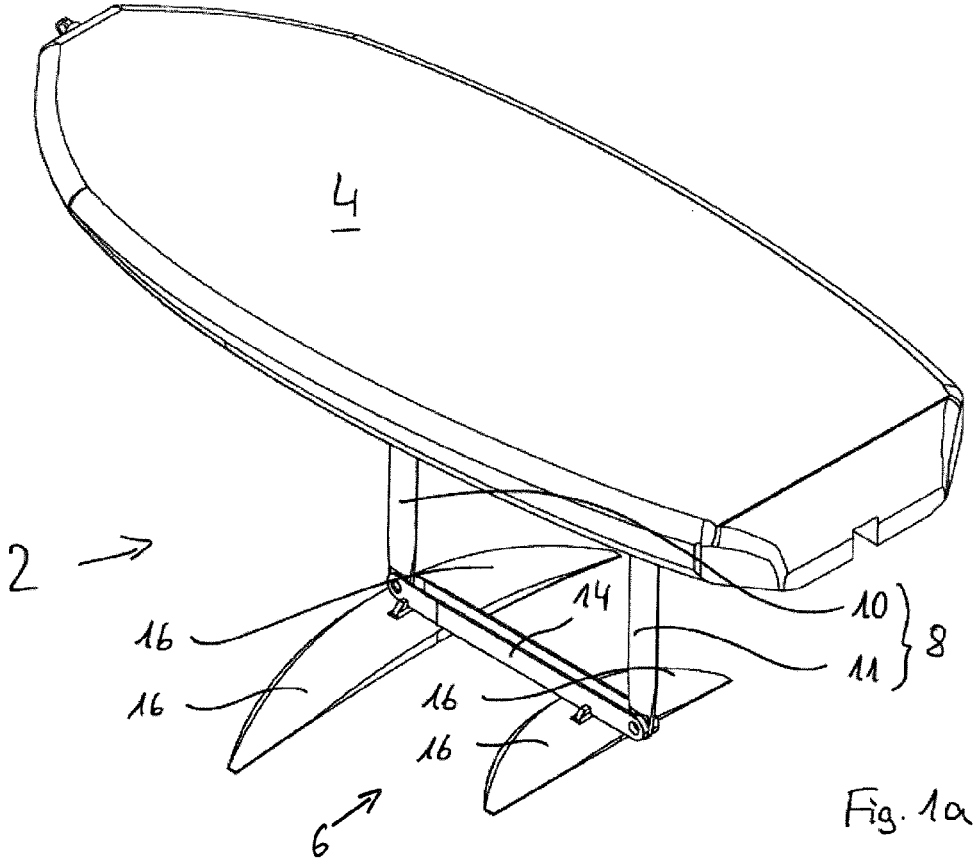
FIGS. 1*a* to 1*h* show different views of a first water sports device according to the invention both in the rest and/or starting position and in the operating position.
Figure 1B:
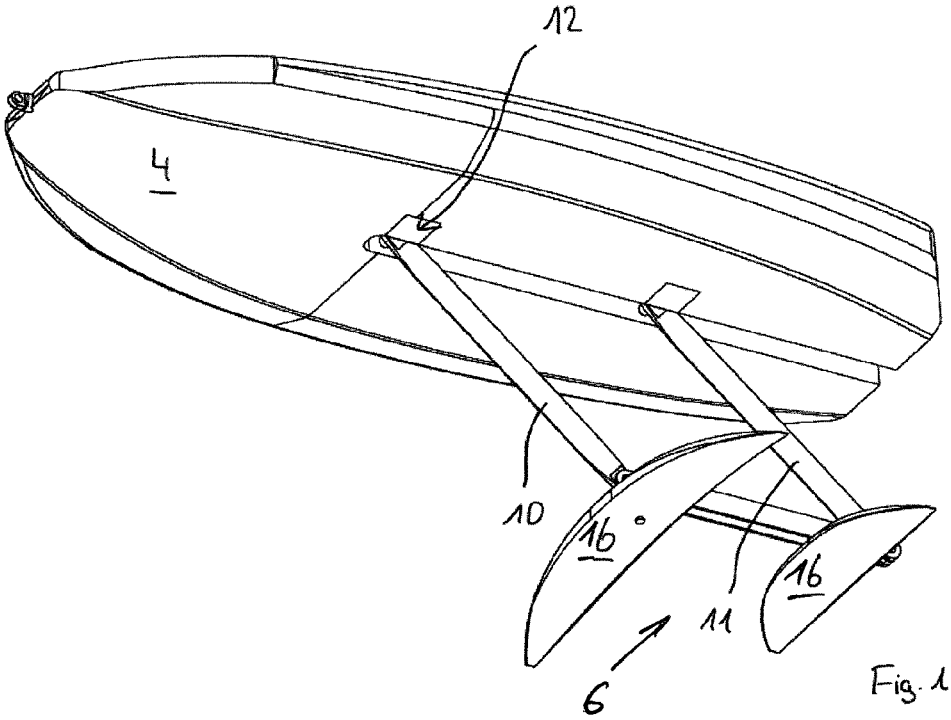
Figure 1C:
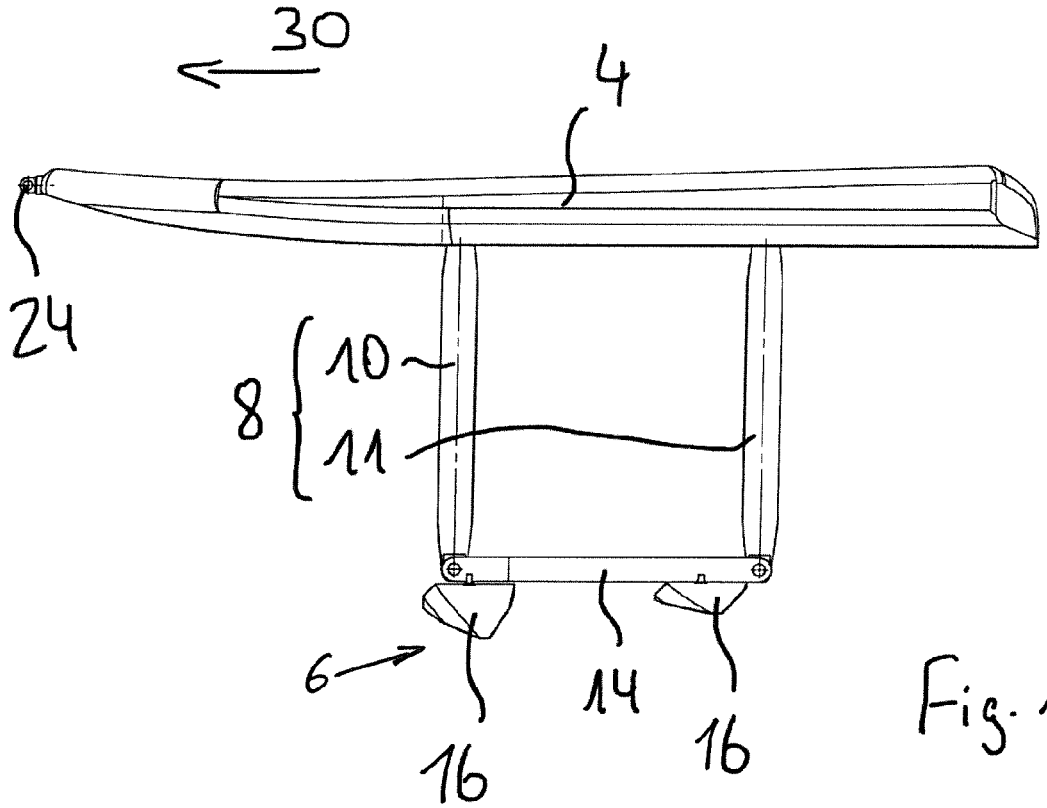
Figure 1D:
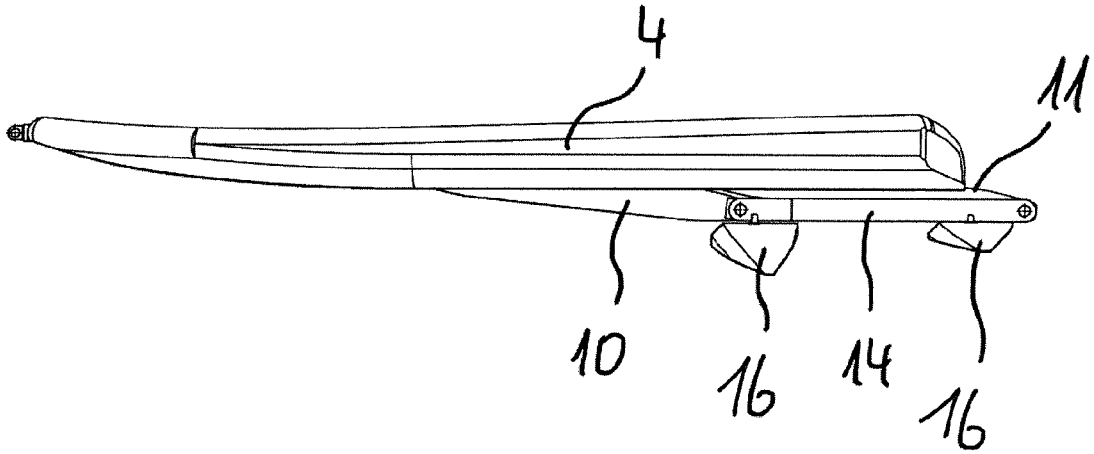
Figure 1E:
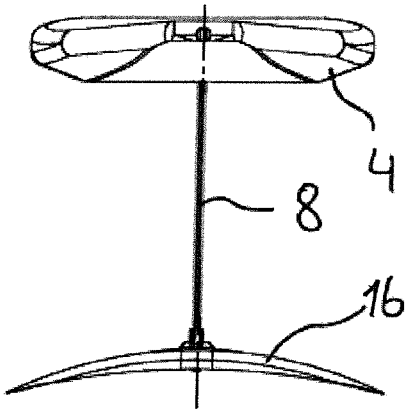
Figure 1F:
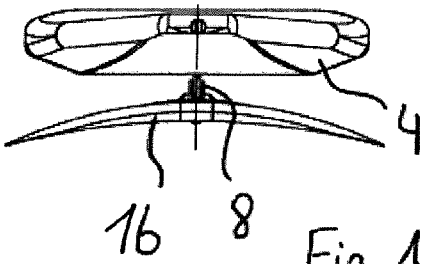
Figure 1G:
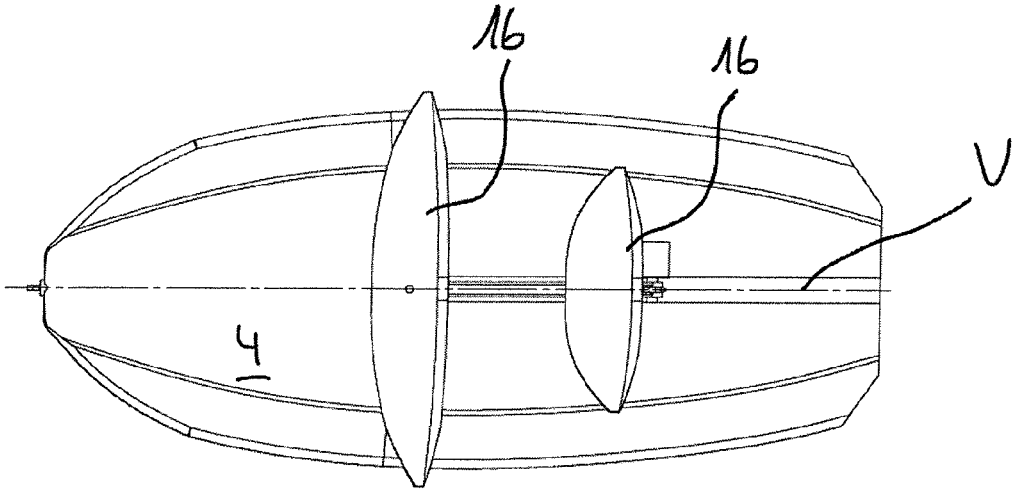
Figure 1H:
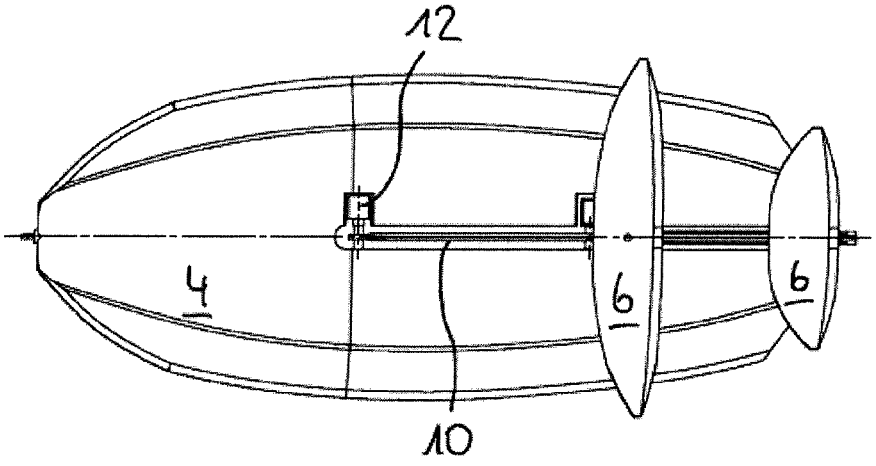
Figure 2A:
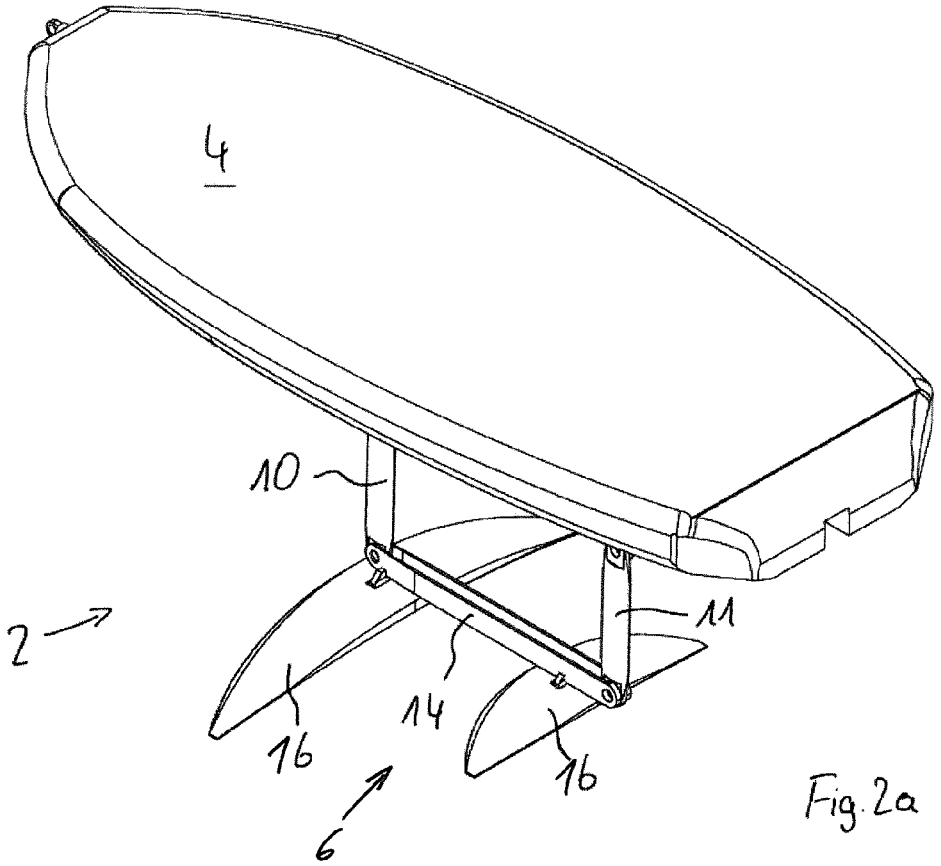
FIGS. 2*a* to 2*d* show different views of a second water sports device according to the invention both in the rest and/or starting position and in the operating position.
Figure 2B:
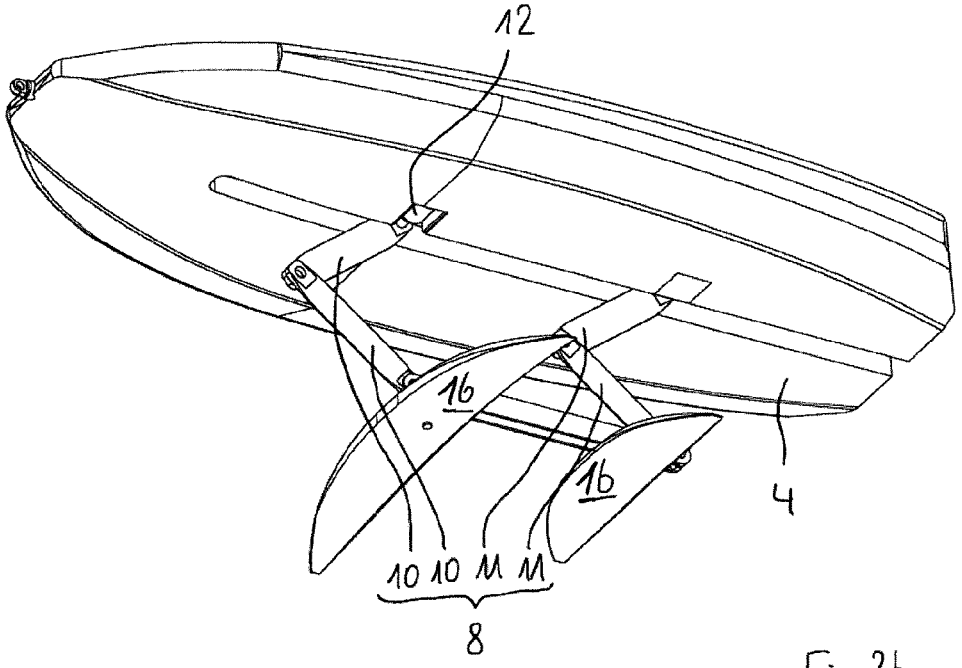
Figure 2C:
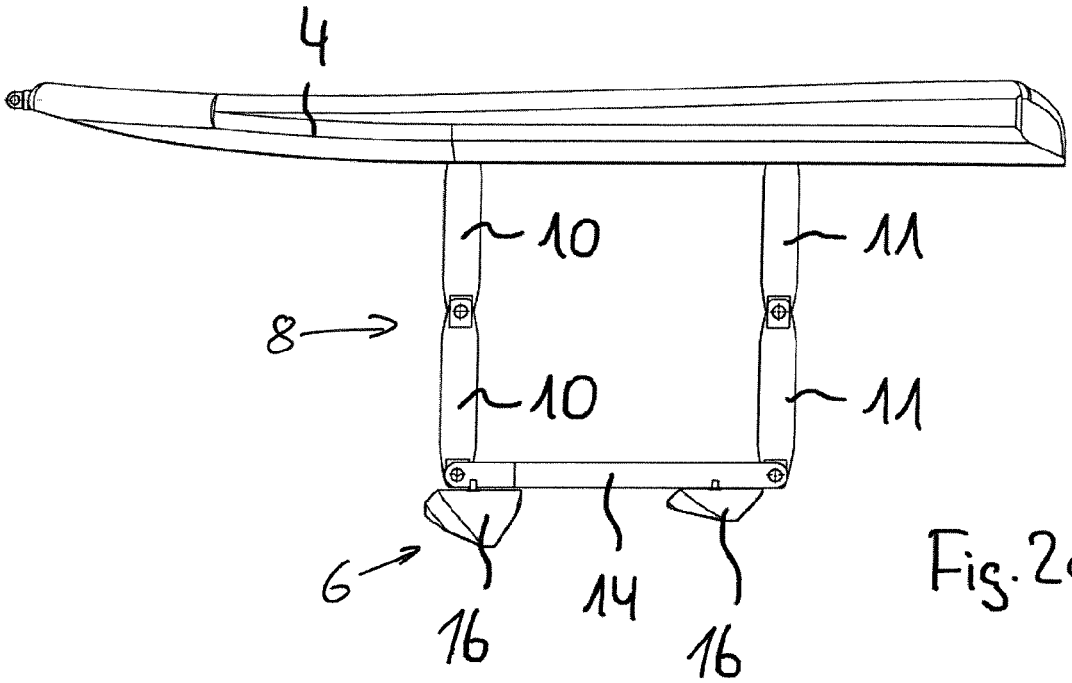
Figure 2D:
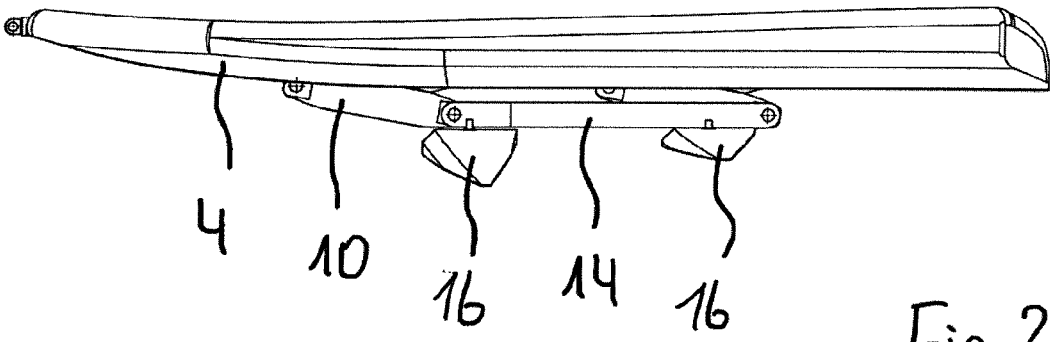
Figure 6A:
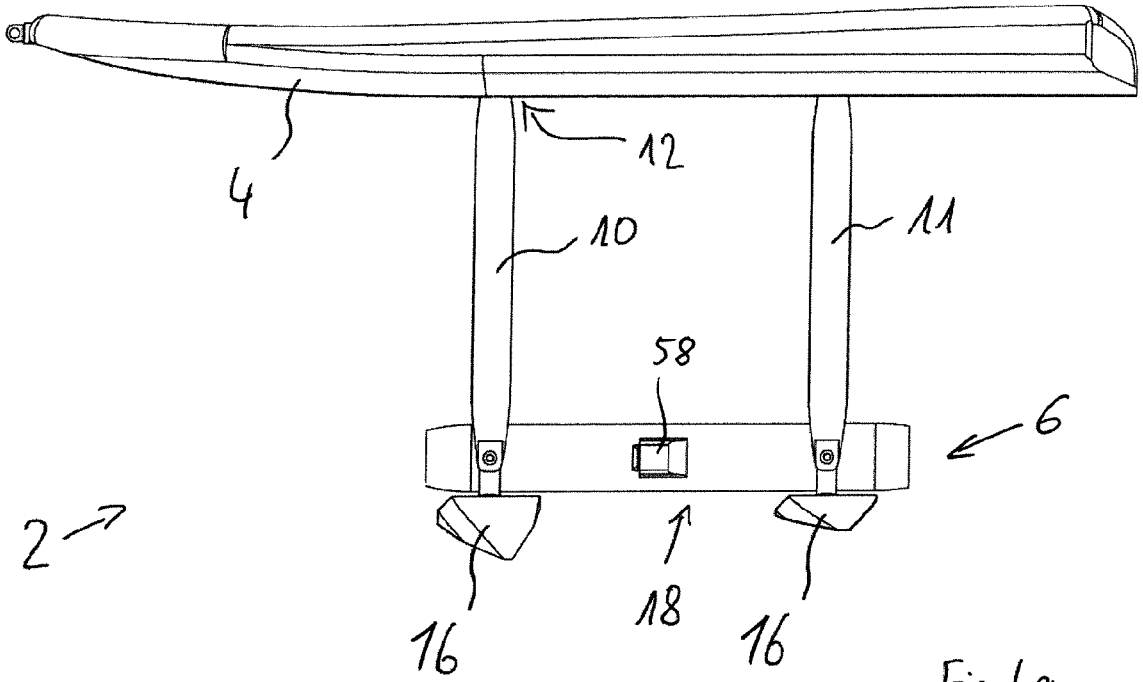
FIGS. 6*a* and 6*b* show different views of a sixth water sports device according to the invention in the operating position.
Figure 6B:
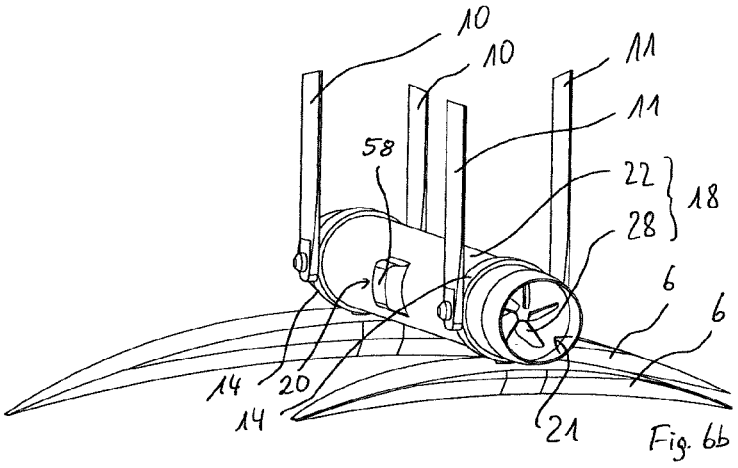

FIGS. 1*a* to 6*a* are different views of different water sports devices 2 according to the invention, and FIG. 6*b* is a partial, perspective illustration of the water sports device 2 according to FIG. 6*a*. With the exception of FIG. 6*a*, the figures which end with a show a perspective view of the respective water sports device 2 showing an upper side of the float 4 and, with the exception of FIG. 6B, the figures which end with b show a further perspective view of the respective water sports devices 2 showing a lower side of the float 4. The figures which end with c and d, and FIG. 6*a*, show side views of the respective water sports devices 2. FIGS. 1*a* and 1*f* show front views of the first water sports device 2, and FIGS. 1*g* and 1*h* show bottom views of the same water sports device 2. The figures which end with a and b, and FIGS. 1*e*, 1*g* and 6*b*, show the respective water sports device 2 in an operating position, and the figures which end with d, and FIGS. 1*h* and 1*f*, show the respective water sports devices 2 in a rest and/or starting position. With the exception of FIG. 6*b*, the figures which end with b show the respective water sports devices 2, while the latter are in an intermediate position between the operating position and the rest and/or starting position.

The different water sports devices 2 which are shown are configured as a foil-board. The water sports devices 2 in each case have a float 4 which is configured as a swimming board and is largely of coinciding form with a frontal fastening means 24 (cf. FIG. 1*c*). Moreover, the water sports devices 2 have a hydrofoil surface apparatus 6 which in turn comprises two hydrofoil surfaces 16 which are arranged on the two sides of a vertical longitudinal plane V (cf. FIG. 1*g*). The hydrofoil surface apparatuses 6 are fastened to the float 4 in each case by means of a holding apparatus 8, and are arranged thereon, in particular, movably relative to the float 4.

The holding apparatus 8 comprises at least one first link 10 which is configured for coupling the float 4 to the hydrofoil surface apparatus 6. The hydrofoil surface apparatus 6 can be transferred via the holding apparatus 8 from the rest and/or starting position into the operating position, in which the hydrofoil surface apparatus 6 is arranged spaced apart further below the float. In the case of the water sports devices 2 according to FIGS. 1 to 4 and 6, the transfer takes place by way of, in particular, a translational movement of the hydrofoil surface apparatus 6, as a result of which the latter is preferably oriented in the operating position in the same way as in the rest and/or starting position.

In the case of intended use of the water sports device 2 in or on a body of water, the hydrofoil surface apparatus 6 is situated below the water surface, whereas the float 4 is arranged at least partially above the water surface. During a forward movement in the movement direction 30 (FIG. 1*c*), the hydrofoil surfaces 16 bring about buoyancy, by way of which the float 4 is transferred into a position which is spaced apart from the water surface and which it is supported via the holding apparatus 8 on the hydrofoil surface apparatus 6 which is still situated in the water.

The holding apparatus 8 has a drive 12, by way of which the hydrofoil surface apparatus 6 can be transferred out of the rest and/or starting position into the operating position and/or out of the operating position into the rest and/or starting position. To this end, the drive 12 comprises an energy store. In the exemplary embodiments of the invention which are shown, the drive 12 is arranged in a recess of the float 4, and comprises an electro-mechanical or electro-pneumatic motor. By way of said motor, the energy store can be prestressed and/or potential energy can be introduced into it, which potential energy can be called up for moving the at least one first link 10 out of the energy store. Between the motor and the energy store, the drive 12 comprises a transmission gear mechanism, by way of which the torque which is to be generated by the motor for the introduction of kinetic energy into the energy store is lowered.

The first water sports device 2 according to the invention (FIGS. 1*a* to 1*h*) has a holding apparatus 8 with a first link 10 and a further link 11 which is positioned behind it in the movement direction. They configure a parallel guide for the transfer of the hydrofoil surface apparatus 6 from the operating position into the rest and/or starting position and back. In detail, the links 10, 11 are arranged such that they can be pivoted both relative to the float 4 and relative to the hydrofoil surface apparatuses 6 about pivot axes which are orthogonal with respect to the vertical longitudinal axis V, and have the same length. In detail, the links 10, 11 are arranged on a receptacle 14 of the hydrofoil surface apparatus 6.

The second water sports device 2 according to the invention (FIGS. 2*a* to 2*d*) comprises a holding apparatus 8 with two first links 10 and two second links 11 which are arranged behind the first links 10 in the movement direction. The links 10, 11 are arranged at one end in an articulated manner on the float 4 or on the receptacle 14 for the hydrofoil surface apparatus 6, and are coupled at the other end in an articulated manner to the respective other first or further link 10, 11. As a result of this configuration of a knee joint, the links act as toggle levers, by way of which the hydrofoil surface apparatus 6 can be transferred into the respective positions. In the case of a transfer, the two first links 10 and the two further links 11 are deflected, in particular, by the same angle, but with a different mathematical sign with respect to the float 4. In the case of both the first and the second water sports device 2, the device 12 is configured for pivoting the first link 10 which is arranged on the float 4.

Figure 3A:
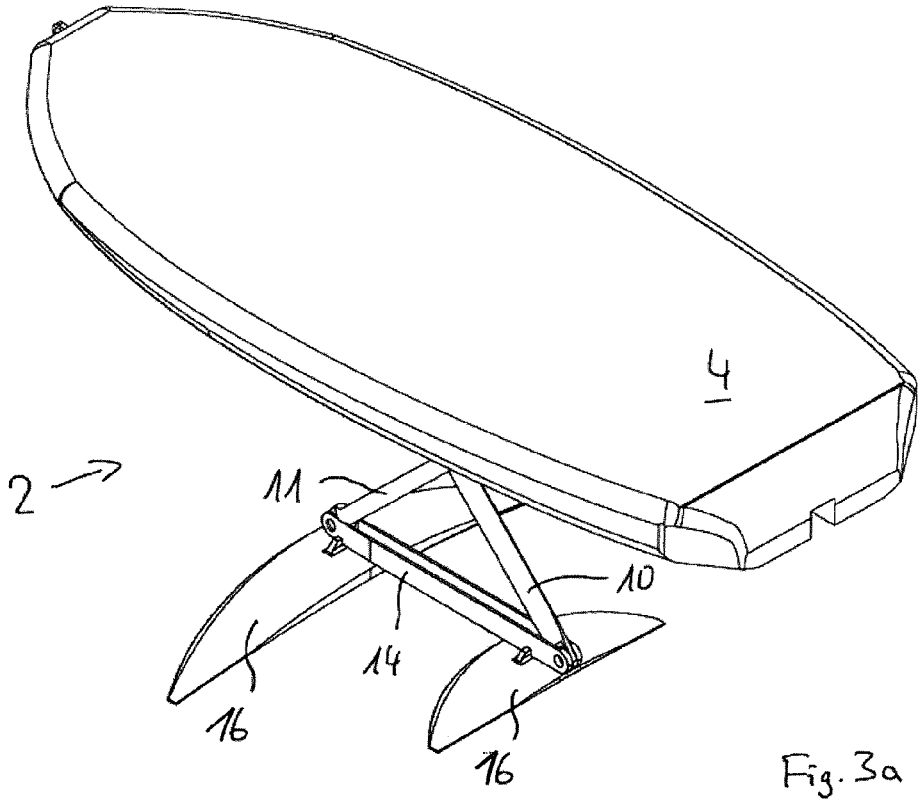
FIGS. 3*a* to 3*d* show different views of a third water sports device according to the invention both in the rest and/or starting position and in the operating position.
Figure 3B:
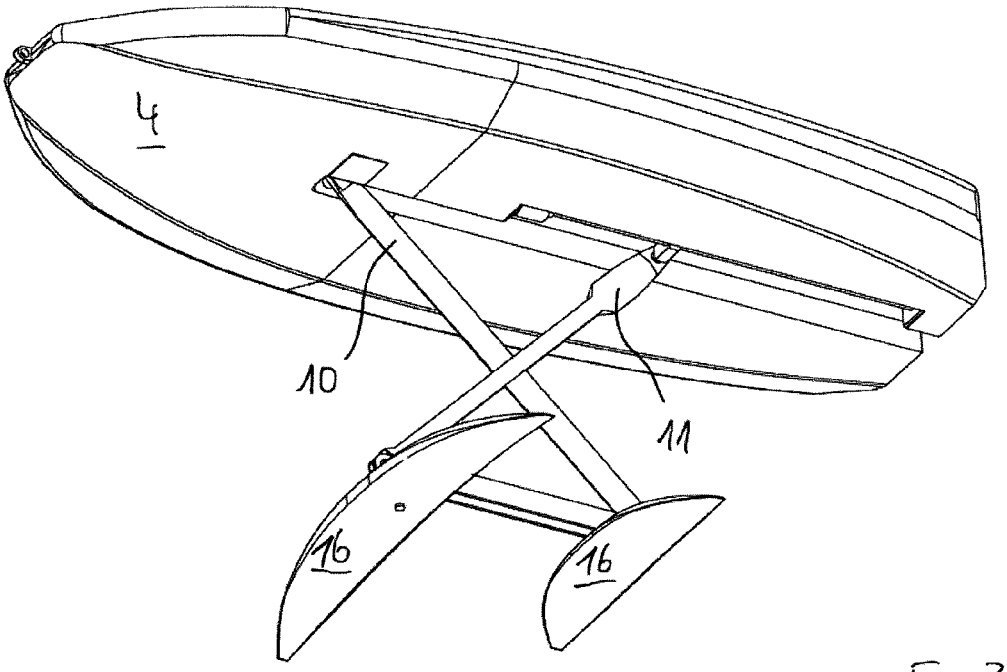
Figure 3C:
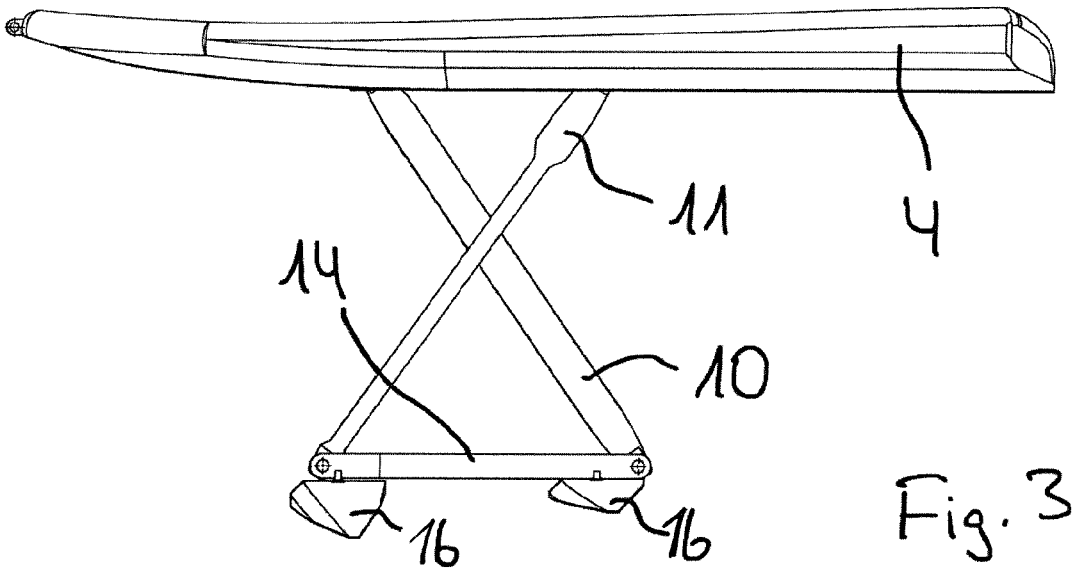
Figure 3D:
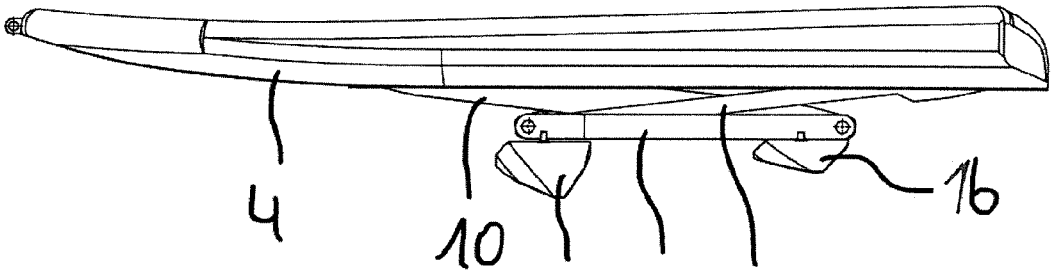
Figure 4A:
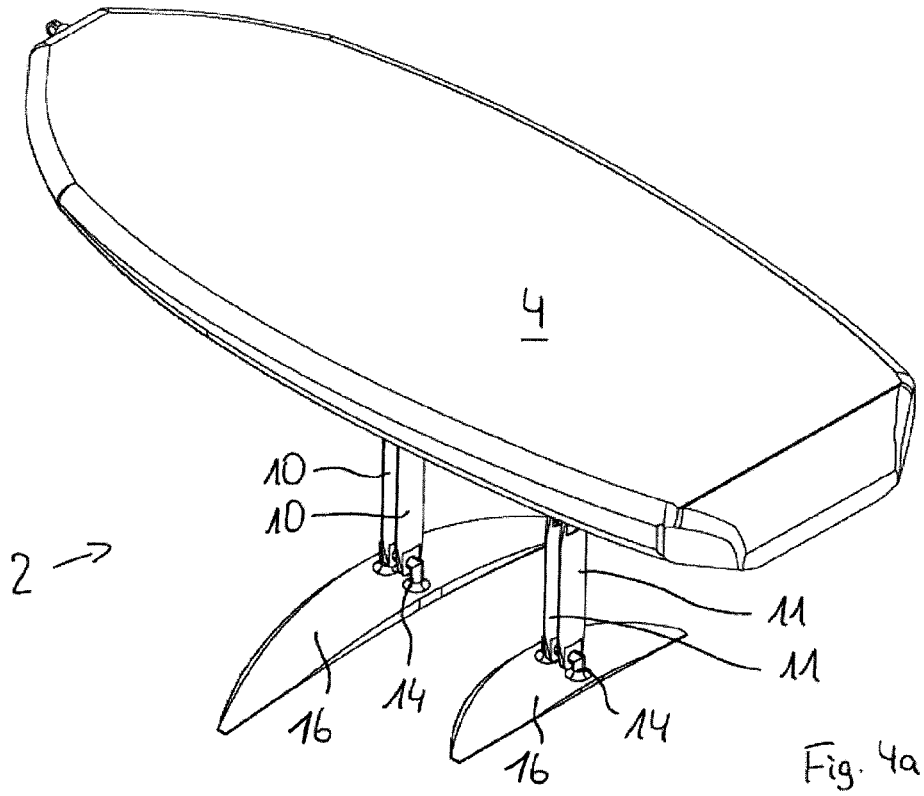
FIGS. 4*a* to 4*d* show different views of a fourth water sports device according to the invention both in the rest and/or starting position and in the operating position.
Figure 4B:
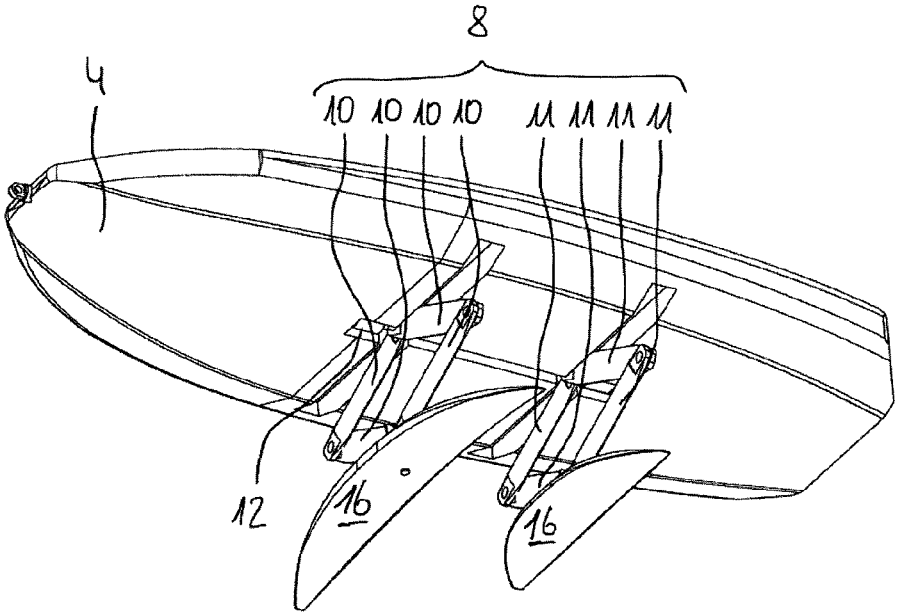
Figure 4C:
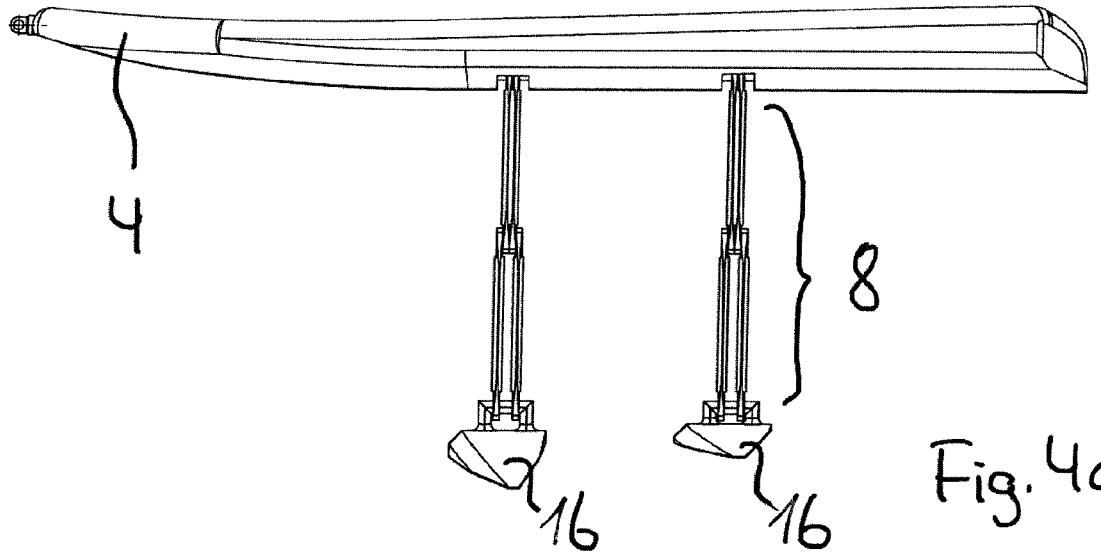
Figure 4D:
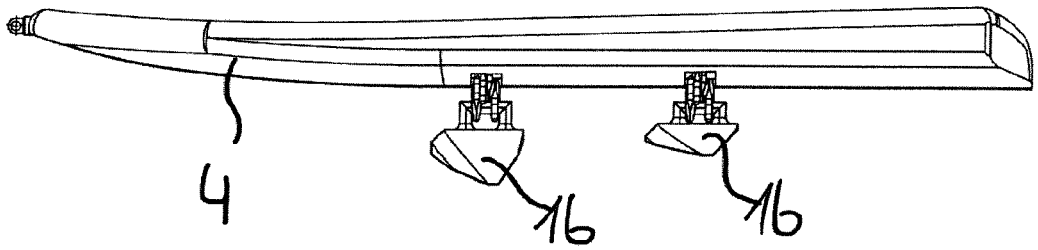
Figure 5A:
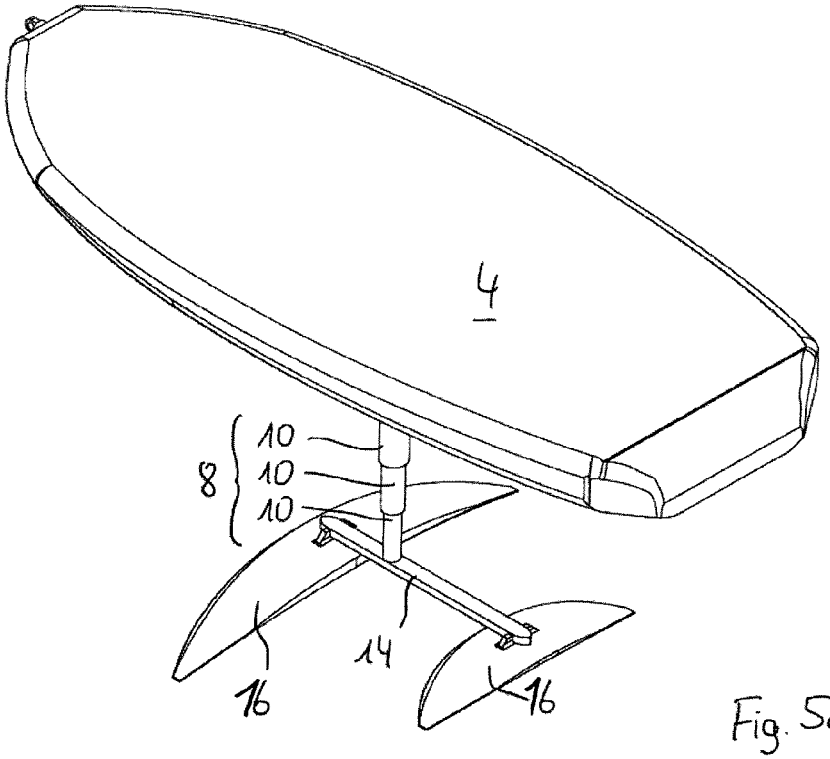
FIGS. 5*a* to 5*d* show different views of a fifth water sports device according to the invention both in the rest and/or starting position and in the operating position.
Figure 5B:
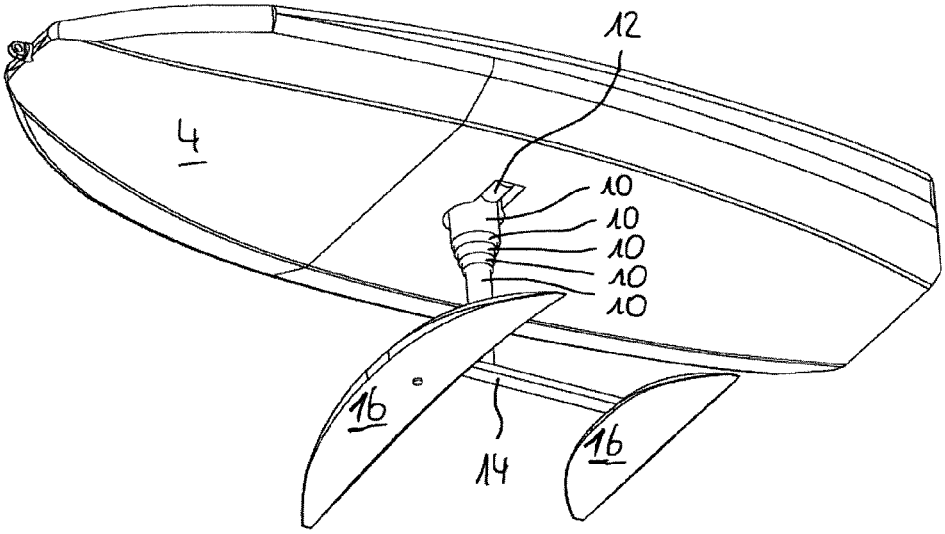
Figure 5C:
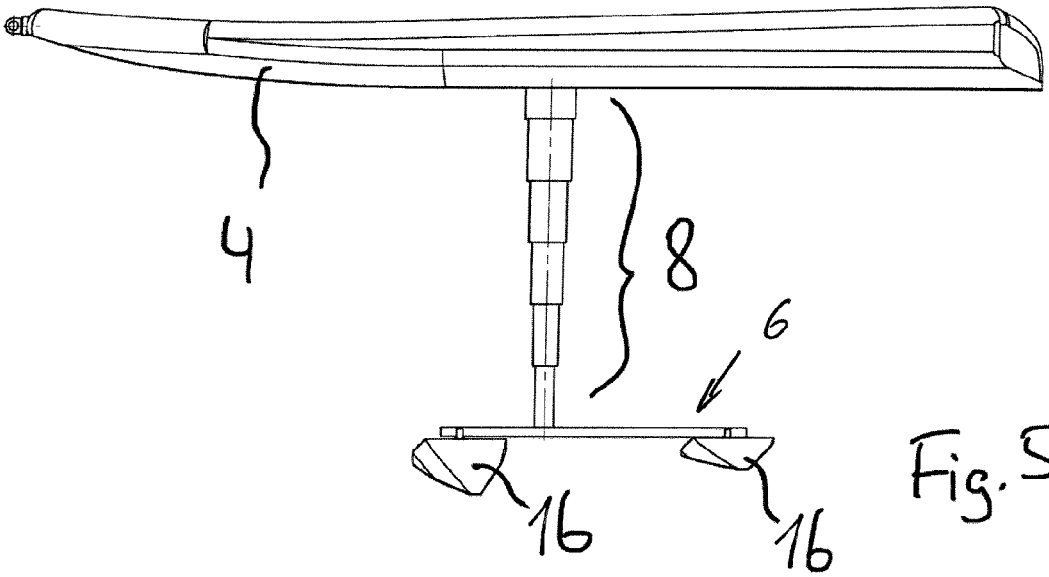
Figure 5D:
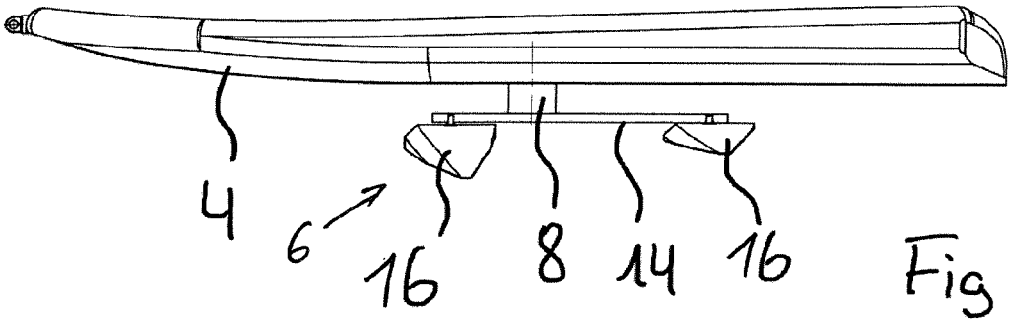

The third water sports device 2 (cf. FIGS. 3*a* to 3*d*) has a holding apparatus 8 with in each case a first and a further link 10, 11 which are arranged so as to cross at least in the operating position in a side view according to FIG. 3*c*. In particular, the first link 10 is coupled to the second link 11 by means of a pivoting bearing (not shown). The two links 10, 11 are arranged pivotably at one end on the float 4 and at the other end on the receptacle 14, that end of the further link 11 which is arranged on the float 4 being arranged such that it can additionally be displaced relative to the float 4. As an alternative or in addition, the drive 12 serves for pivoting of the first link 10 in order to displace the further link 11.

The fourth water sports device 2 (FIGS. 4*a* to 4*d*) has a two-part holding apparatus 8, of which each part comprises four links 10, 11 and a split hydrofoil surface apparatus, the front and rear part of which in each case have a hydrofoil surface 16. The four links 10, 11 of the two parts in each case form a lever mechanism in the manner of a car jack, the links 10, 11 being pivoted about pivot axes which lies in the vertical longitudinal axis during the transfer. In one alternative embodiment, the holding apparatus 8 is configured in one piece in the manner of a car jack, the links 10, 11 of which can be pivoted about pivot axes which are orthogonal with respect to the vertical longitudinal plane, and that end of the holding apparatus 8 which faces away from the float 4 is preferably arranged on a receptacle 14 of the hydrofoil surface apparatus 6.

The fifth water sports device 2 (FIGS. 5*a* to 5*d*) comprises a telescopic holding apparatus 8 with a plurality of first links 10 which are mounted inside one another and can be displaced with respect to one another. The first link 10 which faces away from the float 4 is arranged on a receptacle 14 of the hydrofoil surface apparatus 6. As an alternative or in addition, the drive 12 serves for pivoting the first links 10 in order to telescope them.

The sixth water sports device 2 (FIGS. 6*a* and 6*b*) comprising a holding apparatus 8 which is configured as a parallel guide within each case two first links 10 and further links 11. In the side view according to FIG. 6*a*, the first links 10 and the further links 11 are arranged in each case behind one another. The links 10, 11 are arranged with their ends which face away from the float 4 on receptacles 14. The hydrofoil surface apparatus 6 has a propulsion device 18 which is arranged between the identical links 10, 11 for driving the water sports device 2 in the movement direction. The propulsion apparatus 18 comprises a propulsion body 22 which configures a flow duct with two openings 20, 21. During operation of the propulsion apparatus 18, water passes through the inlet opening 20 into the flow duct. An impeller 28 which is situated in said flow duct and is shown merely symbolically in FIG. 6*b* accelerates the water therein, which water leaves the flow duct through the outlet opening 21. The impeller 28 is of hubless and shaftless configuration, and is driven via a motor which is configured as an internal rotor. Respective housing wall parts 58 configure inlet openings 20 on two sides of the drive body.

Figure 7A:
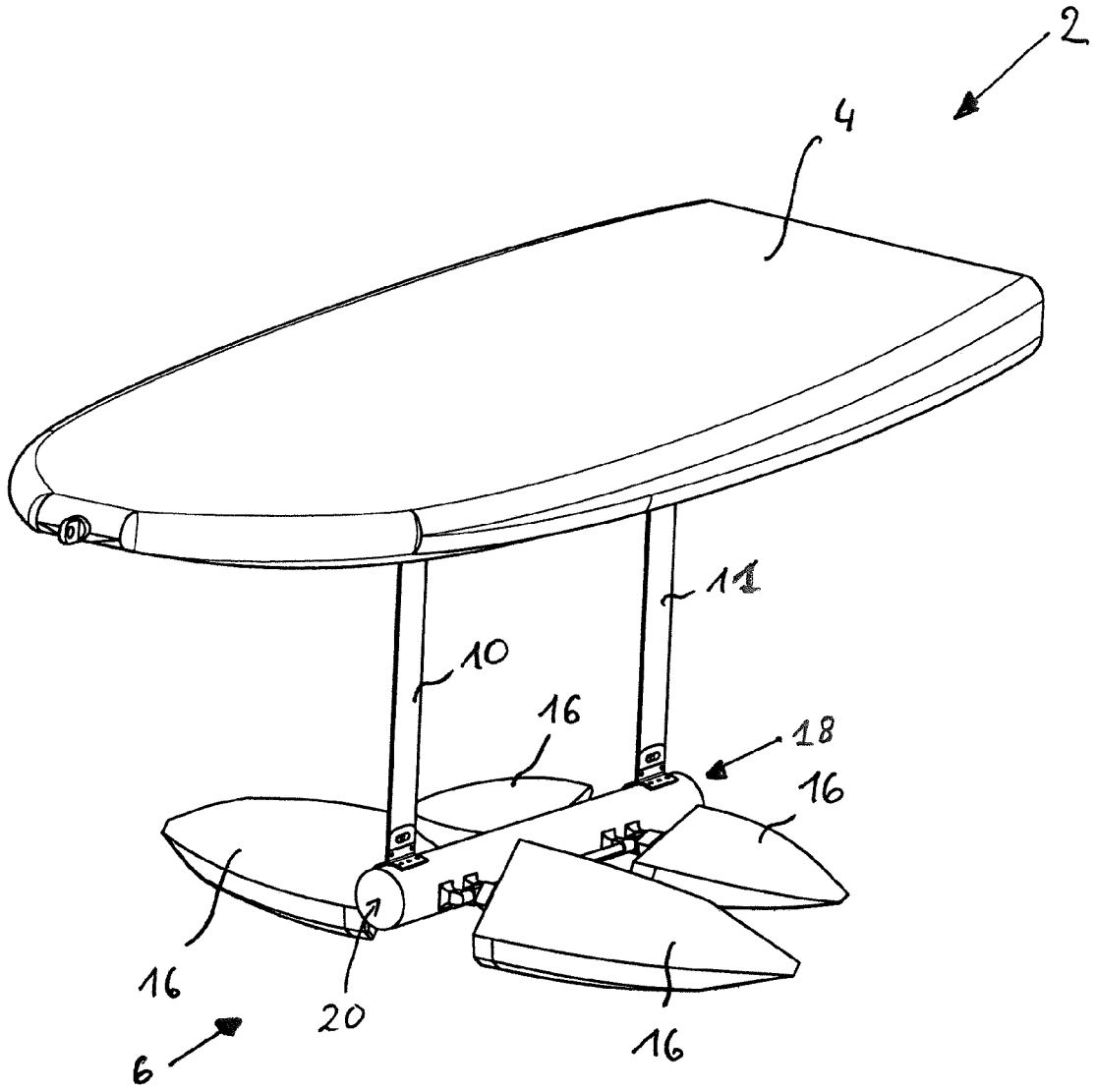
FIGS. 7*a* to 7*c* show a seventh water sports device according to the invention in a perspective view.
Figure 7B:
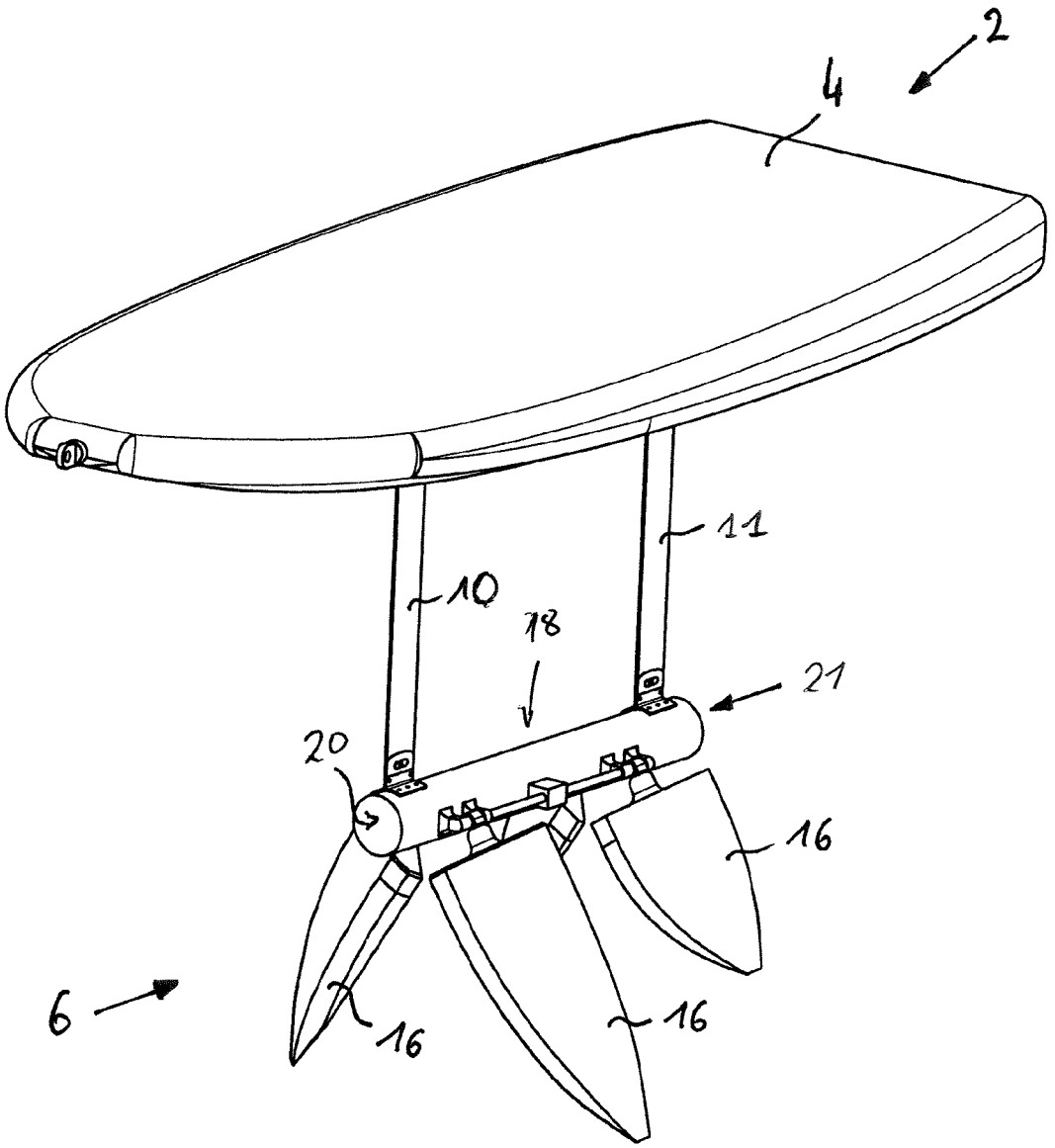
Figure 7C:
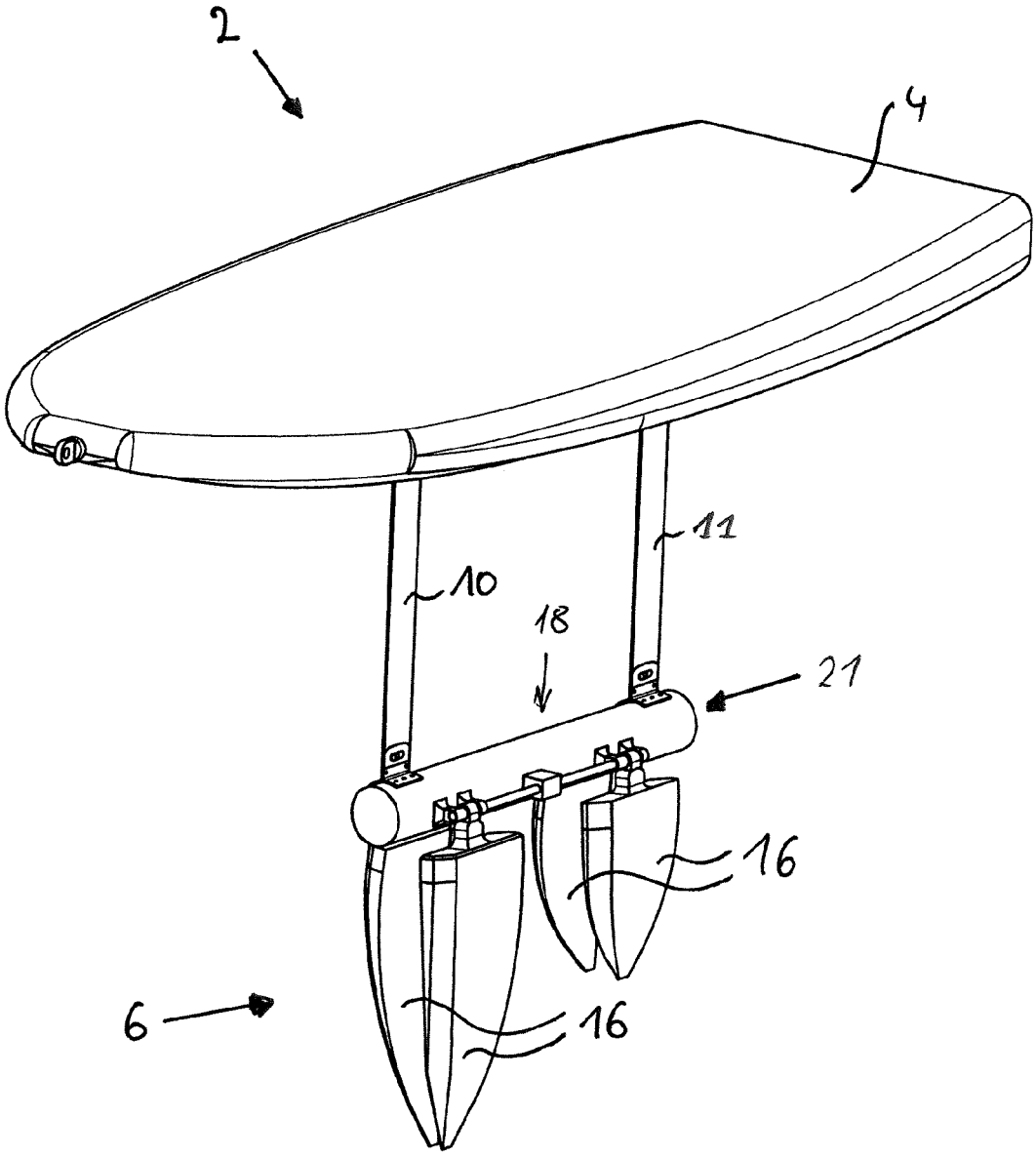
Figure 8A:
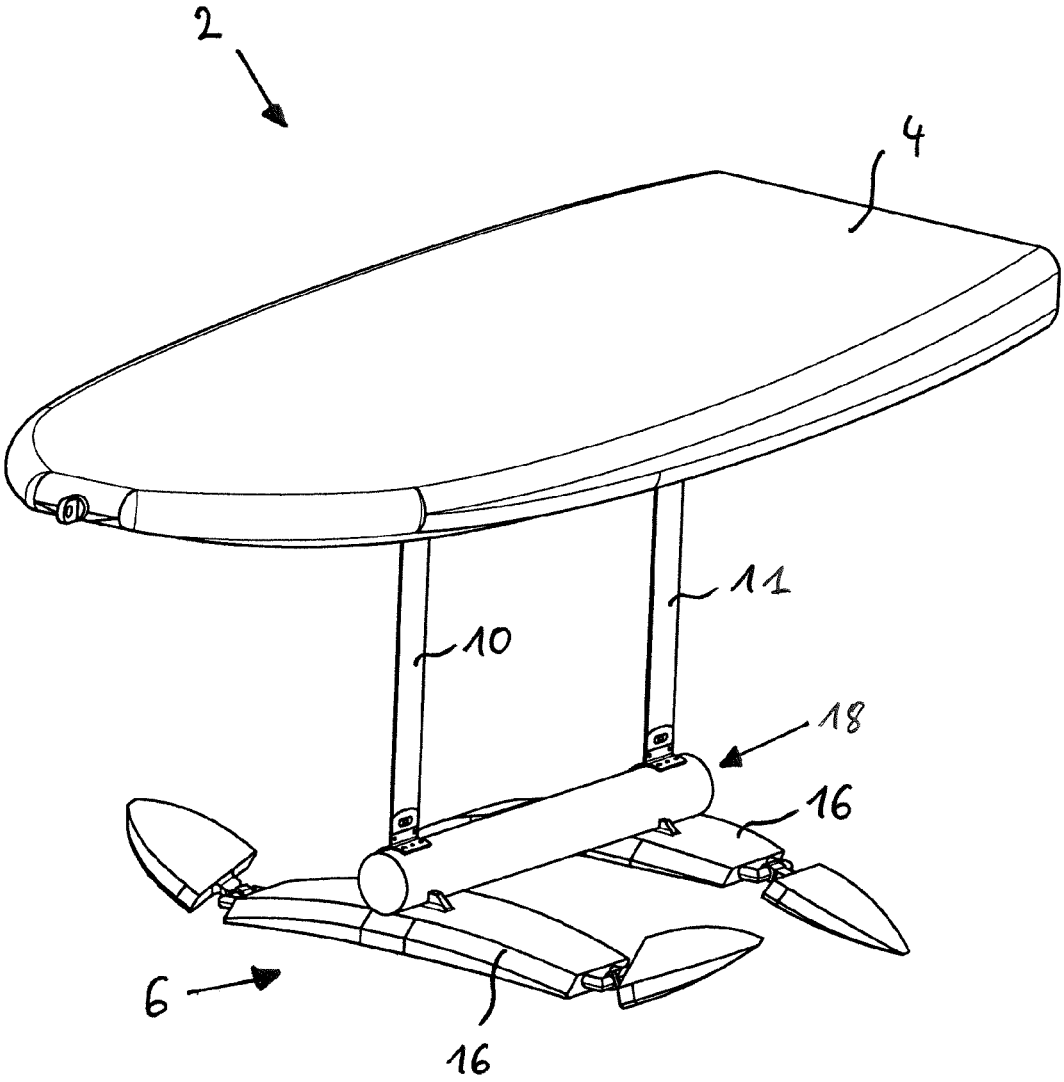
FIGS. 8*a* and 8*b* show an eighth water sports device according to the invention in a perspective view.
Figure 8B:
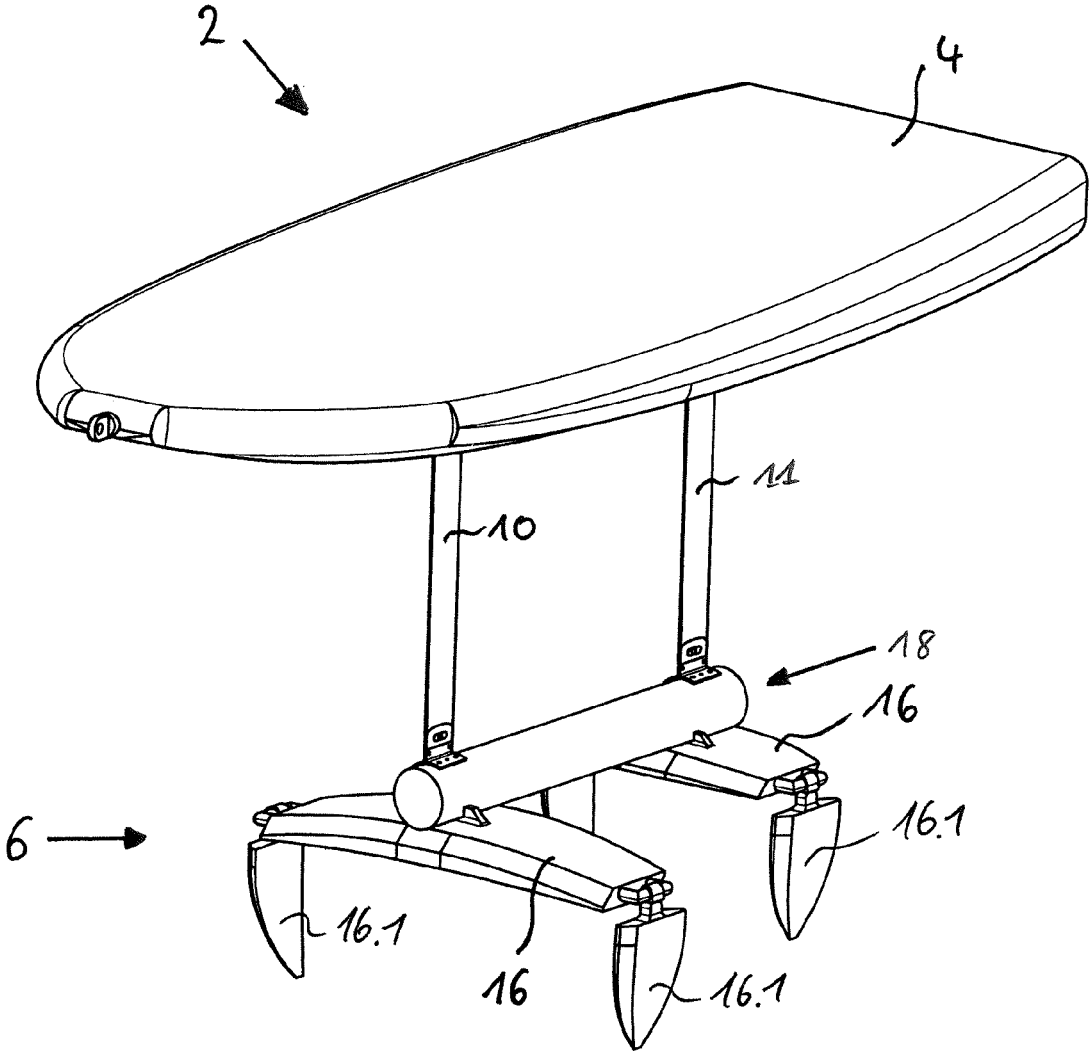

FIGS. 7 and 8 show two further water sports devices 2 with alternative embodiments of the hydrofoil surface apparatus 6 or the hydrofoil surfaces 16. The hydrofoil surface apparatus 6 is arranged on the propulsion apparatus 18. In the variant according to FIG. 7, the individual hydrofoil surfaces are arranged in a pivotable manner directly on the propulsion apparatus 7. FIG. 7*a* shows the hydrofoil surfaces 16 in the neutral position. In FIG. 7*b*, the hydrofoil surfaces 16 are pivoted downward and at the same time the right-hand (in the movement direction of the water sports device 2) hydrofoil surfaces 16 are pivoted counter to the propulsion direction. FIG. 7*c* shows the hydrofoil surfaces in a transport position or rest position. A control unit of the water sports device 2 can actuate the individual hydrofoil surfaces 16 in such a way that automatic self-stabilization of the water sports device 2 in the water takes place and/or another desired movement state, for example a height of the float above the water surface, is achieved.

FIG. 8 shows an alternative embodiment of the hydrofoil surface apparatus 6. Here, a front and a rear hydrofoil are arranged on the propulsion apparatus 18, which front and rear hydrofoil at least partially configure the hydrofoil surfaces 16. Pivotable tips or parts 16.1 of the hydrofoil surfaces 16 are arranged on said rigid hydrofoils in each case at the ends, which pivotable tips or parts can be pivoted into various positions. As a result, stabilization of the water sports device 2 can also be achieved by way of adjustment of the hydrofoil surfaces 16, merely the pivotably arranged tips of the hydrofoil surfaces 16 in FIG. 8. As an alternative or in addition, the hydrofoil surfaces 16 can also have rear (in the movement direction) adjustable parts in a similar manner to an elevator of an aircraft wing.

Figure 10:
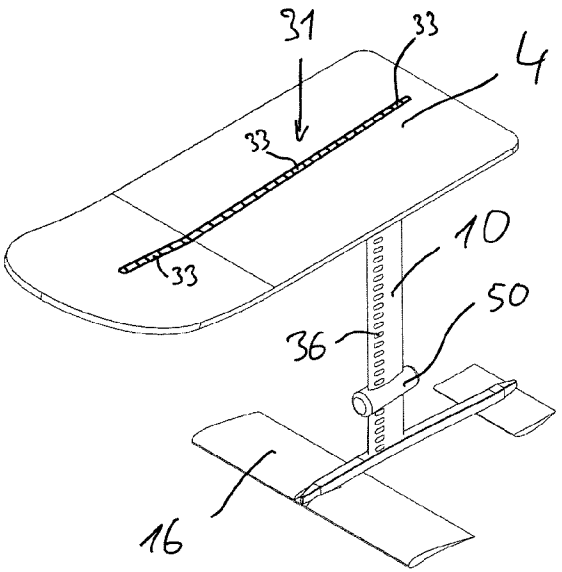
FIGS. 9 to 12 show further exemplary embodiment according to the invention.
Figure 9:
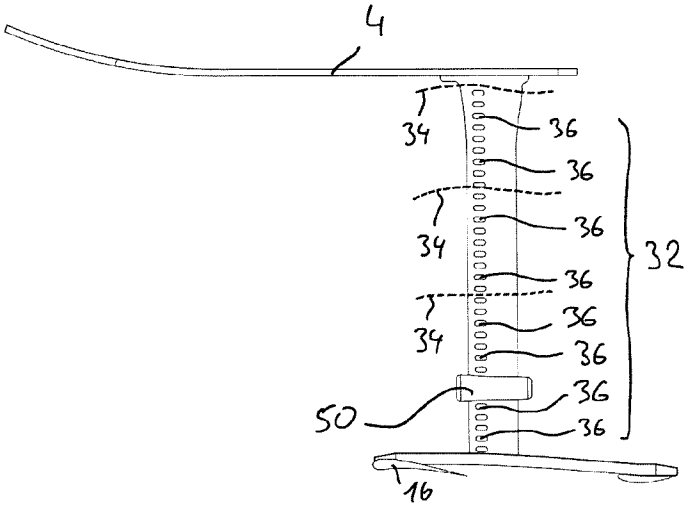

In accordance with a further exemplary embodiment according to the invention, a plurality of capacitive sensors 36 for configuring a movement state sensor 32 are arranged along a link 10 of the holding apparatus 8 (FIGS. 9 and 10). Said capacitive sensors extend uniformly over a large part of the link 10 along its longitudinal extent and transmit corresponding data to a control unit which is preferably arranged in the float 4, in a manner which is dependent on whether they are arranged above or below a water surface 34 which is indicated in each case by way of dashed lines. As a result, a spacing of the float 4 from the water surface can be determined in said control unit, where-upon, in the case of undesired states, the control unit can adapt, for example, the thrust of the propulsion apparatus 50 which is integrated into the link 10 or an angular position of a hydrofoil surface 16.

The exemplary embodiment of FIGS. 9 and 10 has, furthermore, a visual display unit 31 which is integrated into the float and shows the spacing of the float 4 from the water surface. The display unit 31 comprises a plurality of multicolor LED units 33 which are laminated in, with the result that the spacing from the water surface 34 can be shown via the number and/or wavelength of the illuminating LED units 33.

Figure 12:
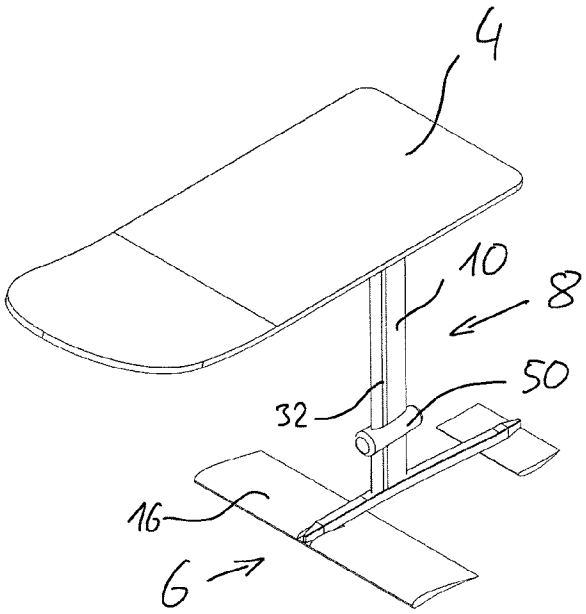
Figure 11:
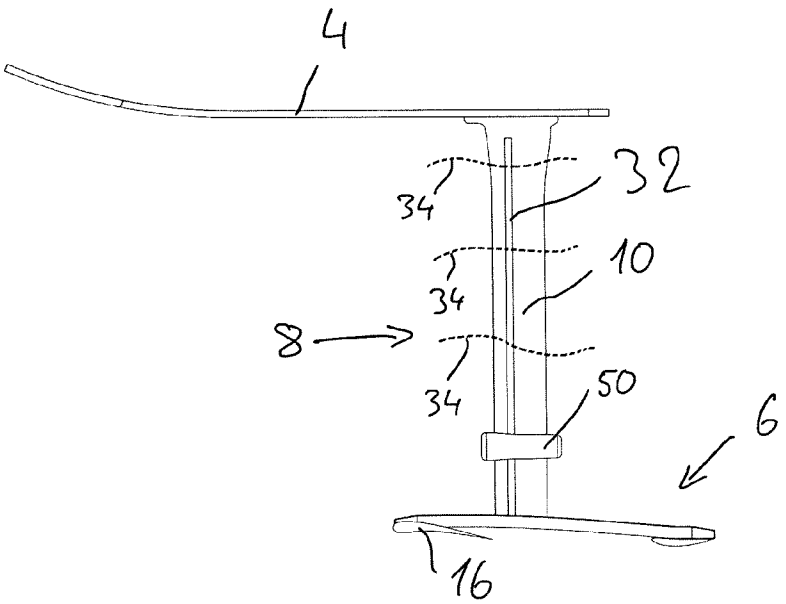

In the case of a further exemplary embodiment, a movement state sensor 32 is likewise arranged along a link 10 of the holding apparatus 8 (FIGS. 11 and 12). Said movement state sensor 32 extends over a large part of the link 10 along its longitudinal extent and is arranged both above and below the propulsion apparatus 50 which is integrated into the link 10. The movement state sensor 32 is configured as a capacitive sensor in the form of a sensor strip, and forwards different signals to the control unit in a manner which is dependent on the various dashed lines 34 which represent water surfaces. Said control unit can regulate, for example, the drive power or the angular position of the hydrofoil surfaces 16 on the basis of said sensor data.

Regardless of the illustrations of FIGS. 9 to 12 with links 10 which are arranged rigidly on the respective float 4, they can also be configured such that they can be varied in accordance with the claim between an operating position and a rest and/or starting position.

The invention claimed is:

1. A water sports device, the water sport device being a foilboard, the foilboard comprising:

a float, wherein the float is a swimming board;

at least one hydrofoil surface apparatus;

a holding apparatus having at least one first link, the holding apparatus fastening the float to the at least one hydrofoil surface apparatus;

the hydrofoil surface apparatus having one or more hydrofoil surfaces, and the hydrofoil surface apparatus being transferrable via the holding apparatus into an operating position below the float, the float being transferrable in the operating position and during a forward movement on account of buoyancy brought about by way of the hydrofoil surface apparatus into a position which is spaced apart from the water surface, the hydrofoil surface apparatus is transferrable via the holding apparatus out of a rest and/or starting position into the operating position and/or out of the operating position into the rest and/or starting position, for which purpose the water sports device has a drive engaged with the holding apparatus to drive the holding apparatus between the rest and starting positions, wherein the drive is provided with an energy store;

wherein the drive of the holding apparatus is arranged in a recess of the swimming board.

2. The water sports device as claimed in claim 1, wherein the hydrofoil surface of the hydrofoil surface apparatus is arranged in the rest and/or starting position in a manner which is oriented at least approximately identically to the operating position.

3. The water sports device as claimed in claim 1, wherein the holding apparatus has at least one further link which is mounted at one end pivotably on or in the float and/or is arranged at the other end pivotably on the hydrofoil surface apparatus.

4. The water sports device as claimed in claim 3, wherein the two links are attached in an articulated manner to a receptacle for the hydrofoil sur-face apparatuses or apparatus.

5. The water sports device as claimed in claim 3, wherein the two links are arranged behind one another in the movement direction.

6. The water sports device as claimed in claim 1, further including at least one depth and/or proximity sensor which is connected to a control unit which is configured for controlling the drive.

7. The water sports device as claimed in claim 6, wherein the control unit is configured to change the spacing of the hydrofoil surface apparatus from the float in a manner which is dependent on the spacing of the water sports device from the bottom and/or an obstacle.

8. The water sports device as claimed in claim 6, wherein the sensor has at least one ultrasonic transducer.

9. The water sports device as claimed in claim 1, wherein the hydrofoil surface apparatus has at least two hydrofoil surfaces which, as viewed in the movement direction, extend away from a central vertical axis to the left and to the right.

10. The water sports device as claimed in claim 1, wherein, as viewed in plan view, the float and/or the hydrofoil surface apparatus are/is of at least approximately delta-shaped configuration.

11. The water sports device as claimed in claim 1, further comprising a fastening means which is arranged on the float.

12. The water sports device as claimed in claim 1, wherein the drive is an electro-mechanical or electro-pneumatic drive.

13. The water sports device as claimed in claim 1, wherein the energy store can be prestressed by means of a motor.

14. The water sports device as claimed in claim 1, wherein the drive has a gear mechanism via which the motor of the drive is connected to the energy store.

15. The water sports device as claimed in claim 1, wherein the energy store has at least one spring which is connected to a link of the holding apparatus, in such a way that its force can be used at least partially for orienting the link.

16. The water sports device as claimed in claim 1, wherein the energy store can be prestressed in opposite directions by way of the motor and/or gear mechanism.

17. The water sports device as claimed in claim 1, further including a propulsion apparatus which is provided for the propulsion of the water sports device and is configured at least partially as part of the hydrofoil surface apparatus or is arranged at least partially between the holding apparatus and the hydrofoil surface apparatus.

18. The water sports device as claimed in claim 17, wherein the propulsion apparatus comprises at least one impeller or propeller.

19. The water sports device as claimed in claim 18, wherein the impeller is arranged in a flow duct of a propulsion body, which flow duct is connected to the surrounding area via at least two openings.

20. The water sports device as claimed in claim 1, wherein the hydrofoil surface apparatus is configured for setting different angles of attack of at least one part of the one or more hydrofoil surfaces and/or of rudders of the hydrofoil surface apparatus.

21. The water sports device as claimed in claim 1, further including at least one movement state sensor for determining the spacing of the float and/or the hydrofoil surface apparatus from the water surface.

22. The water sports device as claimed in claim 1, further including a visual display unit.

* * * * *